United States Patent [19]

Tsuda et al.

[11] 4,298,270

[45] Nov. 3, 1981

[54] ELECTROGRAPHIC APPARATUS

[75] Inventors: Hiroshi Tsuda, Mitaka; Kiyoshi Miyashita; Masaji Nishikawa, both of Hachioji; Akira Shimizu, Fuchu; Muneo Kasuga, Hachioji, all of Japan

[73] Assignee: Olympus Optical Company Limited, Tokyo, Japan

[21] Appl. No.: 116,391

[22] Filed: Jan. 29, 1980

[30] Foreign Application Priority Data

Feb. 2, 1979 [JP] Japan ..... 54/11134

[51] Int. Cl.[3] ..... G03G 15/00

[52] U.S. Cl. ..... 355/3 SH; 271/248; 271/273; 355/14 SH

[58] Field of Search ..... 355/3 SH, 3 R, 75, 14 SH; 271/226, 238, 240, 248, 273

[56] References Cited

U.S. PATENT DOCUMENTS 4,186,919 2/1980 Miciukiewicz ..... 355/3 SH 4,188,028 2/1980 Miciukiewicz ..... 355/3 SH 4,243,316 1/1981 Gustafson ..... 355/3 SH

*Primary Examiner*—Richard L. Moses

*Attorney, Agent, or Firm*—Fleit & Jacobson

[57] ABSTRACT

An electrographic apparatus comprising a main body, a manuscript discharge tray, a slit light exposure portion, a manuscript feed mechanism including upper and lower feed mechanisms, the upper feed mechanism being arranged movably with respect to the lower feed mechanism, a photosensitive body, a sheet manuscript edge guide, a thick manuscript edge guide and means for automatically changing the two edge guides in response to a movement of the upper feed mechanism with respect to the lower feed mechanism; the apparatus being constructed and arranged such that in the case of obtaining copies of a sheet manuscript the sheet manuscript is fed by the manuscript feed mechanism under a condition that the upper feed mechanism is mounted on the lower feed mechanism and scanned by exposed light by one time and in the case of obtaining copies of a thick manuscript a thick manuscript carriage on which is disposed the thick manuscript is fed by the lower feed mechanism under a condition that the upper feed mechanism is moved from the lower feed mechanism and scanned by exposed light by one time.

19 Claims, 22 Drawing Figures

ELECTROGRAPHIC APPARATUS

BACKGROUND OF THE INVENTION

1. Field of the Invention

This invention relates to an electrographic apparatus which can obtain copies of a thick manuscript and a sheet manuscript.

2. Description of the Prior Art

Various kinds of electrographic apparatuses have heretofore been proposed and used in practice. One of these conventional electrographic apparatuses is mainly used for obtaining copies of a thick manuscript such as books or the like, while the other electrographic apparatus is mainly used for obtaining copies of a sheet manuscript.

In the electrographic apparatus mainly used for obtaining copies of the thick manuscript, in the case of obtaining copies of the sheet manuscript, the sheet manuscript is disposed on a manuscript carriage and urged against it by a manuscript holding cover. The manuscript carriage or a projection optical system is reciprocated for number of times corresponding to the number of sheets to be copied, thereby obtaining copies. In this case, the operation of opening and closing the manuscript holding cover in order to set the sheet manuscript on the manuscript carriage is troublesome in operation. In addition, wind pressure produced when the manuscript holding cover is opened and closed tends to displace or blow off the sheet manuscript set beforehand, thereby rendering the operation very inconvenient and bad in efficiency. In general, the kind of the manuscript to be copied belonging to the sheet manuscript is far larger than that belonging to the thick manuscript. As a result, the above is the important drawback inherent to the electrographic apparatus mainly obtaining copies of the thick manuscript.

On the other hand, the electrographic apparatus mainly used for obtaining copies of the sheet manuscript is classified into one type in which the sheet manuscript is directly inserted into and passes through a light exposure portion so as to be scanned by exposed light and into another type in which if the sheet manuscript is introduced into the apparatus it is automatically set to a given position where it is repeatedly scanned by the exposed light for the number of times corresponding to the number of the sheet manuscripts to be copied and then is automatically discharged from the apparatus.

The former type electrographic apparatus can insert the sheet manuscripts in succession into the light exposure portion and hence is very rapid in operation if compared with the above mentioned electrographic apparatus mainly used for obtaining copies of the thick manuscript and adapted to change a previous manuscript to the next manuscript after the previous manuscript has been scanned by the exposed light.

In addition, the former type electrographic apparatus is not required to use a reciprocating mechanism for the manuscript carriage or projection optical system, so that the apparatus as a whole is simple in construction and can be manufactured in a less expensive manner. But, in the case of obtaining a plurality of copies from the same manuscript, the manuscript must repeatedly be inserted into the light exposure portion for number of times corresponding to the number of copies to be obtained, and as a result, the apparatus becomes very troublesome in operation and bad in efficiency.

The latter type electrographic apparatus has the advantage that a desired number of copies can be obtained by inserting the sheet manuscript only one time into the apparatus. But, this apparatus has the drawback that the apparatus as a whole is complex in construction, that a manuscript feed path is complex in construction and hence is troublesome in feed operation and that the manuscript tends to be easily broken.

The former type electrographic apparatus can obtain copies of the thick manuscript with the aid of a suitable auxiliary means. On the contrary, it is almost impossible to obtain copies of the thick manuscript by the latter type electrographic apparatus. To the electrographic apparatus mainly used for obtaining copies of the thick manuscript has been added a sheet manuscript feed mechanism which can automatically feed a sheet manuscript disposed on a manuscript carriage and automatically discharge it after a required number of sheets have been repeatedly scanned by the exposed light. But, such kind of sheet manuscript feed mechanism is complex in construction and large in size and hence is generally used only for an expensive high speed copying machine.

The auxiliary means added to the former type electrographic apparatus mainly used for obtaining the sheet manuscript and operative to obtain copies of the thick manuscript comprises a sheet manuscript driving roller, its corresponding driven roller and an end driven roller independent of the driven roller and arranged at the outside of the driven roller, the end driven roller being co-operative with the driving roller so as to feed a light transmission thin plate for the thick manuscript and constructed such that in the case of obtaining copies of the thick manuscript the sheet manuscript feed driven roller is pushed aside or removed and the light transmission thin plate with the thick manuscript disposed thereon is held between the driving roller and the end driven roller so as to be fed and scanned by the exposed light. That is, the light transmission thin plate in such auxiliary means is fed at a given feed speed by means of a friction force produced between the driving roller and the end driven roller. But, in the case of obtaining copies of the thick manuscript by means of such auxiliary means, an operator is always required to hold down the thick manuscript by a pressure which is sufficient to prevent the thick manuscript from displacing or from rising during feed of the light transmission thin plate. As a result, unreasonable force is subjected to the light transmission thin plate while it is fed. The frictional force produced between the driving roller and the end driven roller for feeding the light transmission thin plate sandwiched therebetween becomes changed. As a result, it is impossible to maintain the given feed speed, thereby inducing a blur in copy or an inclined displacement of the light transmission thin plate. As a result, in the case of using such auxiliary means, the operator is required to have a certain order of skill and operate with the greatest possible care. In addition, the end driven roller is projected from the surface along which the light transmission thin plate passes, so that the operator is also required to pay attention not to damage his finger or the manuscript got caught in the projected end driven roller.

In the case of obtaining a plurality of copies from the same manuscript, the above mentioned operation must be repeated, so that the operation becomes more complex and the rate of damaging the precious manuscript becomes high. In addition, the separate need of the driven roller exclusively used for feeding the thick manuscript makes the apparatus complex in construction.

The applicant has been proposed an electrographic apparatus which can eliminate the above mentioned drawbacks, that is, which can obtain copies of sheet manuscript and thick manuscript without damaging the manuscript in a simple manner, and which can obtain a desired number of copies with an extremely high efficiency by scanning the manuscript only one time by exposed light (U.S. Patent Application Ser. No. 26,760 and German Patent Application No. P29 15633.0).

The proposed electrographic apparatus comprises a substantially rectilinear manuscript feed path including a slit light exposure portion through which is projected a manuscript image; a manuscript feed mechanism including upper and lower feed mechanisms arranged above and below said manuscript feed path at said slit light exposure portion with said manuscript feed path interposed therebetween, said upper feed mechanism being mounted movably with respect to said slit light exposure portion; and a photosensitive body for memorizing said manuscript image projected through said slit light exposure portion thereon as an electrostatic latent image; the apparatus being constructed and arranged such that in the case of obtaining copies of a sheet manuscript said sheet manuscript is fed by said manuscript feed mechanism under a condition that said upper feed mechanism is mounted on said lower feed mechanism and scanned by exposed light by one time and in the case of obtaining copies of a thick manuscript a thick manuscript carriage on which is disposed said thick manuscript is fed by said lower feed mechanism under a condition that said upper feed mechanism is moved from said lower feed mechanism and scanned by exposed light by one time, thereby producing on said photosensitive body an electrostatic latent image corresponding to said manuscript image and obtaining a plurality of copies on the basis of said electrostatic latent image.

In this electrographic apparatus, use is made of a thick manuscript carriage comprising a flat transparent light exposure portion on which a thick manuscript to be copied is disposed, a carrying member which is driven without skipping by a thick manuscript feed mechanism of the electrographic apparatus and a member for determining a position of the thick manuscript at the light exposure portion; the light exposure portion, the carrying member and the position determining member being assembled into a single unit to form the thick manuscript carriage. The thick manuscript carriage is mounted on the thick manuscript feed mechanism with its one side parallel to the feed direction set along an edge guide provided on the electrographic apparatus. Then, a thick manuscript can be fed under a condition that the thick manuscript is positioned correctly.

In such an electrographic apparatus, it is preferable to arrange an edge guide for determining a position of a side of the thick manuscript carriage outside an edge guide for determining a position of a side of a sheet manuscript. However, in such an apparatus the two edge guides must be changed over each other when a manuscript to be copied is changed from a thick manuscript to a sheet manuscript or vice versa. For this purpose, in said apparatus the edge guide for a sheet manuscript can be displaced with respect to the edge guide for the thick manuscript feed carriage, the latter edge guide being fixed. However, this change of edge guides is manually operated by a user and is often forgotten by the user. In this case, a position of a manuscript to be copied is not correctly set so that the manuscript cannot be recorded on a recording paper. In addition, this manual change requires a complicated and troublesome operation for a user of the electrographic apparatus.

SUMMARY OF THE INVENTION

An object of the invention is to provide an electrographic apparatus which obviates the above mentioned defects. That is, in the electrographic apparatus a user need not manually change over the edge guides when a manuscript to be copied is changed from a sheet manuscript to a thick manuscript or vice versa, so that there is no risk of mis-copying. Thus, the operation of the apparatus according to the invention is simple and not troublesome.

A feature of the invention is the provision of an electrographic apparatus comprising a main body with a manuscript carriage; a manuscript discharge tray detachably mounted on said main body; a slit light exposure portion mounted on said main body and interposed between said manuscript carriage and said manuscript discharge tray, said slit light exposure portion defining a substantially rectilinear manuscript feed path and projecting a manuscript image therethrough; a manuscript feed mechanism including upper and lower feed mechanisms arranged above and below said manuscript feed path at said slit light exposure portion, said upper feed mechanism being arranged movably with respect to said lower feed mechanism; a photosensitive body for memorizing said manuscript image projected through said slit light exposure portion thereon as an electrostatic latent image; a sheet manuscript edge guide for determining a position of a side edge of a sheet manuscript; a thick manuscript edge guide for determining a position of a side edge of a thick manuscript, said thick manuscript edge guide being arranged outside said sheet manuscript edge guide in a direction perpendicular to said manuscript feed path; and means for automatically changing said two edge guides to be used in response to a movement of said upper feed mechanism with respect to said lower feed mechanism; the apparatus being constructed and arranged such that in the case of obtaining copies of a sheet manuscript said sheet manuscript is fed by said manuscript feed mechanism under a condition that said upper feed mechanism is mounted on said lower feed mechanism and in the case of obtaining copies of a thick manuscript a thick manuscript carriage on which is disposed said thick manuscript is fed by said lower feed mechanism under a condition that said upper feed mechanism is moved from said lower feed mechanism.

Further objects and features of the invention will be fully understood from the following detailed description with reference to the accompanying drawings, in which:

DETAILED DESCRIPTION OF THE PREFERRED EMBODIMENTS

Figure 1:
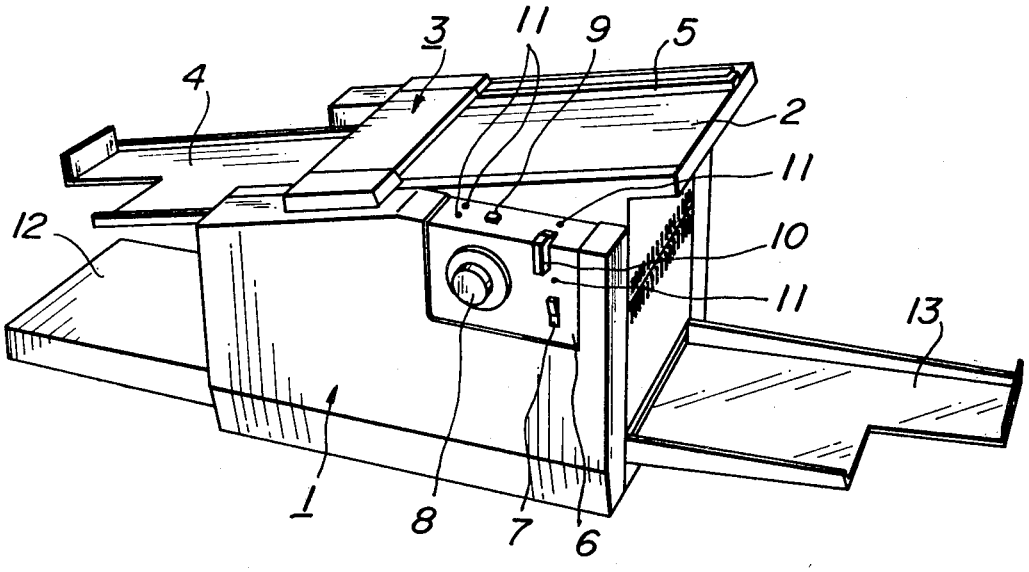
FIG. 1 is a perspective view of one embodiment of an electrographic apparatus according to the invention.

FIG. 1 is a perspective view of an embodiment of an electrographic apparatus according to the present invention. In this embodiment, a plurality of copies can be obtained after a manuscript is only one time scanned by exposing light.

Referring to FIG. 1, reference numeral 1 designates a main body which is provided along its upper surface with a manuscript feed path composed of a manuscript carriage 2, light exposure portion 3 and detachable manuscript discharge tray 4 rectilinearly arranged in the order as mentioned above. A sheet manuscript (not shown) is disposed on the manuscript carriage 2 and slidably moved toward the left as viewed in FIG. 1. The sheet manuscript is held between feed rollers in the light exposure portion 3. The feed rollers cause the sheet manuscript to pass through the light exposure portion 3 at a given speed and discharge it onto the manuscript discharge tray 4. This sheet manuscript feed path is rectilinearly constructed as described above for the purpose of feeding the sheet manuscript without any trouble. In addition, in the present embodiment, the front end of the sheet manuscript feed path viewed in the advanding direction of the sheet manuscript is inclined downwardly for the purpose of effecting insertion and feed of the sheet manuscript in an extremely natural manner. The manuscript carriage 2 is provided at its one side with an edge guide 5 extending along the advancing direction of the manuscript and determining the position of the sheet manuscript to be inserted and serving also as a guide for the manuscript.

The main body 1 is provided at its one side with an operation board 6 including an electric source switch 7, dial 8 for determining the number of copies to be obtained, stop button 9, light adjusting knob 10 and various kinds of display lamps 11. The dial 8 for determining the number of copies to be obtained is rotated so as to set a desired number of copies (1 to 20 in the present embodiment) to be obtained when the manuscript is scanned one time by exposing light. The stop button 9 is pushed to stop the copying operation when it is started under a condition that the dial 8 is set to any erroneous number of copies. The light adjusting knob 10 is moved forwardly or backwardly so as to change the brightness of a fluorescent lamp (not shown) incorporated in the light exposure portion 3 and give a correct exposing light corresponding to the concentration of the manuscript. The display lamps 11 function to display the ON state of the electric source switch 7, start and end of the copying operation, presence and absence of a record sheet in a cassette to be described later, occurrence of jamming operation or the like. A record sheet supply cassette 12 encloses therein record sheets each having a given size and superimposed one upon the other. The cassette 12 is detachably mounted on one end surface of the main body 1. If it is desired to change the size of the record sheet, a cassette enclosing a record sheet having a desired size is selectively mounted on the main body 1. The main body 1 is provided at that end surface which is opposed to the end surface on which is mounted the cassette 12 with a discharge tray 13 for receiving a copy. One end of the discharge tray 13 is rotatably supported by the opposed side surfaces of the main body 1 and the free end of the discharge tray 13 is rotated upwardly about its supporting shaft and releasably locked to the main body 1.

In the embodiment shown in FIG. 1, the manuscript feed path may be made horizontal and the manuscript carriage 2 may be provided at that side edge which is opposed to the edge guide 5 shown in FIG. 1 with another edge guide.

Figure 2:
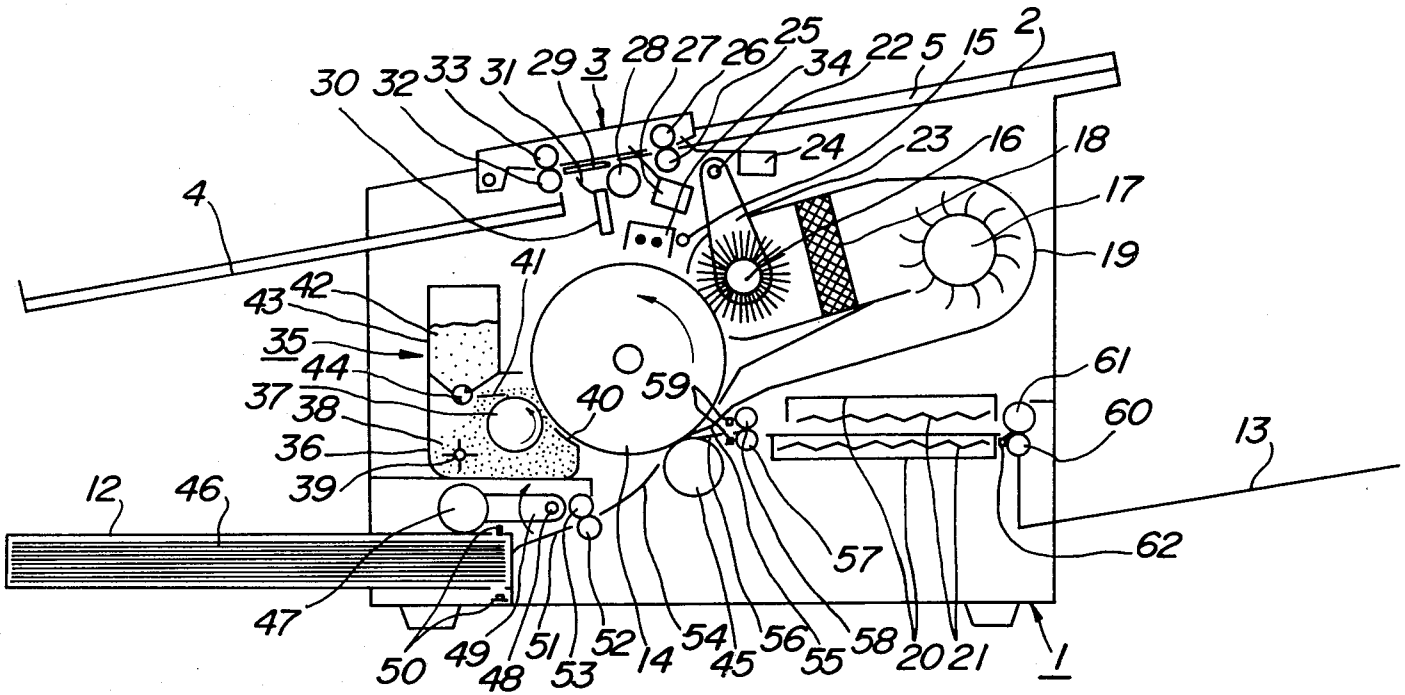
FIG. 2 is a diagrammatic cross-sectional view showing the interior construction of the electrographic apparatus shown in FIG. 1.

FIG. 2 shows one embodiment of an interior construction of the electrographic apparatus shown in FIG. 1 in section. A seamless photosensitive drum 14 is rotatably journaled in the main body 1 and is rotated in a direction shown by an arrow when the electric source switch 7 shown in FIG. 1 is made ON. In the present embodiment, the rotation of the photosensitive drum 14 causes a timing pulse to occur which controls various copying steps. At the same time, an erasion lamp 15 provided near the periphery of the photosensitive drum 14 is made ON and a cleaning brush 16 is rotated to erase the electrostatic latent image remained on the photosensitive drum 14 at the previous copying step and removed toner. The toner removed by the cleaning brush 16 is attracted toward a fan 17 and seized by a filter 18, the fan 17 being rotated by another driving source at the same time as the rotation of the cleaning brush 16. The cleaning brush 16, filter 18 and fan 17 are arranged in a duct 19.

In the present embodiment, the duct 19 is extended up to a transfer portion to be described later and a flow of air sucked by the rotation of the fan 17 is used for the purpose of tearing off the record sheet closely adhered to the photosensitive drum 14 at the trasfer portion. As soon as the electric source switch 17 is made ON, a heater 21 enclosed in a fixing device 20 is energized to raise its temperature.

The cleaning brush 16 is rotatably mounted on an arm 23 which is rotated about a supporting shaft 22 by means of an operating mechanism (not shown) to cause the cleaning brush 16 to bring into contact with and separated from the photosensitive drum 14.

If the photosensitive drum 14 is rotated by one turn to erase the toner and electrostatic latent image remained on the surface of the entire surface thereof and becomes ready for starting the copying step, the above mentioned operating mechanism causes the cleaning brush 16 to separate from the photosensitive drum 14 and at the same time the erasion lamp 15 becomes OFF.

During the preparatory operation from the ON operation of the electric source switch 7 to the end of one rotation of the photosensitive drum 14, a sheet manuscript is disposed on the manuscript carriage 2 and slidably moved along the edge guide 5 toward the light exposure portion 3 until the front end thereof functions to operate a first microswitch 24.

The first microswitch 24 functions to rotate through a clutch mechanism (not shown) a manuscript feed driving roller 25, thereby rotating a driven roller 26 and holding the front end of the sheet manuscript between the rollers 25, 26. As a result, the feed operation of the sheet manuscript is started. If the front end of the sheet manuscript causes a second microswitch 27 to operate, the above mentioned clutch mechanism is released. As a result, the manuscript feed driving roller 25 and driven roller 26 stop respective rotations to stop once the feed operation of the sheet manuscript held between the rollers 25, 26. This condition is maintained during the preparatory operation from the ON operation of the electric source switch 7 to the end of one turn of the photosensitive drum 14. As soon as this preparatory operation is completed, the above mentioned clutch mechanism becomes driven again to cause the manuscript feed driving roller 25 and driven roller 26 to start their sheet manuscript feed operation again.

The manuscript feed driving roller 25 is connected through the above mentioned clutch mechanism and a driving system (not shown) to the photosensitive drum 14 and rotated at a speed which is in synchronism with the peripheral speed of the photosensitive drum 14 to feed the sheet manuscript.

If the feed operation of the sheet manuscript is started again, a fluorescent lamp 28 incorporated in the main body 1 turns ON to illuminate the manuscript. As a result, the sheet manuscript passing along a stage glass 29 is exposed to light. A light image of the manuscript scanned by the exposing light is projected through a projecting optical system 30 to the photosensitive drum 14. In the present embodiment, the projection optical system 30 is composed of a converging optical fiber array. As a result, the manuscript illuminating fluorescent lamp 28 may be composed of a slit-shaped fluorescent lamp having a high brightness and generating little heat, for example, and arranged near the manuscript scanning surface of the stage glass 29.

The projection optical system 30 is provided at that side which is opposed to the fluorescent lamp 28 with a concave reflecting mirror 31 for illuminating the scanning surface of the stage glass 29 with a condensed light, thereby ensuring a required brightness and illuminating the scanning surface without casting a shadow thereon.

The sheet manuscript passed over the stage glass 29 and scanned by the exposing light is held between a manuscript discharge driving roller 32 adapted to be normally rotated as soon as the electric source switch 7 shown in FIG. 1 is made ON and a driven roller 33 and discharged onto the manuscript discharge tray 4.

During the lapse of time in which the sheet manuscript once stopped at the position of the second microswitch 27 is fed again and discharged onto the manuscript discharge tray 4, the photosensitive drum 14 which has completed the above mentioned preparatory operation is rotated in a continuous manner and the surface thereof is uniformly charged with ions delivered from a corona discharge device 34 arranged near the periphery thereof and then illuminated with the light image directed from the projection optical system 30 to produce on the surface thereof an electrostatic latent image corresponding to the manuscript image.

This electrostatic latent image is developed into a visible toned image by means of a developing device 35 arranged near the periphery of the photosensitive drum 14. In the present embodiment, the developing device 35 makes use of a magnet brush developing system using a developing agent formed of two components. The developing device 35 comprises a container 36 in which are arranged a magnet roller 37 rotatable in a direction shown by an arrow and applying toner particles to the photosensitive drum 14, a mixing blade 39 for mixing the toner particles with a carrier in a developing agent 38, a doctor blade 40 for restricting the length of bar-shaped developing agent 38 adhered to the magnet roller 37 and a scraper 41 for scraping off the developing agent 38 which has completed its developing action and adhered to the magnet roller 37. On the container 36 is detachably mounted or made integral therewith a toner supplying container 43 containing toner particles 42 and provided at its lower end with a knurled roller 44. The knurled roller 44 is rotated so as to supply the toner particles 42 to the developing container 36 and hence always maintain any desired concentration of the toner particles in the developing agent 38.

In order to develop the electrostatic latent image on the photosensitive drum 14 without deteriorating it, the carrier of the developing agent 38 may be of one having a high resistance or the magnet roller 37 may be provided around its periphery with an insulating sleeve and either one of the magnet roller 37 and the insulating sleeve is rotated such that the developing agent 38 adhered to the photosensitive drum 14 is moved in a direction opposed to the rotating direction of the photosensitive drum 14.

The developing device 35 may, if necessary, be provided with a developing electrode. In this case, a variable developing bias voltage is applied between the developing electrode and the photosensitive drum 14 so as to control the developing concentration.

The toned image produced on the photosensitive drum 14 by means of the developing device 35 is transferred at a transfer portion to a record sheet by means of a transfer roller 45 urged against the photosensitive drum 14 under a suitable pressure. The transfer roller 45 is formed of an electrically semiconductive resilient material. Between the transfer roller 45 and the photosensitive drum 14 is applied a suitable bias voltage having the same polarity as that of the electrostatic latent image for the purpose of forming an electric field which can transfer the toned image to the record sheet without damaging the electrostatic latent image on the photosensitive drum 14.

As described above, record sheets 46 are enclosed in the cassette 12 and superimposed one upon the other. These record sheets 46 are fed from the cassette 12 one by one by means of a supply roller 47 at a timing which is suitable for transferring the toned image to the record sheet 46 by the transfer roller 45. The sheet supply roller 47 is rotatably mounted on an arm 49 which can rotate about a supporting shaft 38 in two directions shown by arrows and urged against the record sheet 46 in the sheet feed cassette 12 at the above mentioned timing so as to supply it. The main body 1 is provided with a record sheet detecting sensor 50 for detecting presence or absence of the record sheet 46 in the cassette 12 mounted on the main body 1. The record sheet 46 supplied from the cassette 12 by means of the sheet supply roller 47 passes along a sheet guide 51 and is held between register rollers 52 and 53 which function to precisely correct the timing and feed speed of the record sheet 46. Then, the record sheet 46 passes along a sheet guide 54 and is fed between the photosensitive drum 14 and the transfer roller 45, thereby transferring the toned image produced on the photosensitive drum 14 to the record sheet 46.

The record sheet with the toned image transferred thereon is peeled off the photosensitive drum 14 by means of a peeling claw 55 and the flow of air sent through the duct 19 from the above mentioned fan 17. The peeled off record sheet passes along a sheet guide 56 and between a pair of feed rollers 57, 58 and through a record sheet feed path and is fed into the fixing devices 20, 20 arranged above and below the record sheet feed path. In the record sheet feed path between the transfer roller 45 and the feed rollers 57, 58 are arranged record sheet detecting sensors 59, 59 for detecting a jam of the record sheet.

As described above, as soon as the electric source switch 7 shown in FIG. 1 is made ON, the heaters 21 of the fixing devices 20 are energized to raise the temperature during the above mentioned preparatory operation and copying operation to a sufficiently high fixing temperature by the time that the record sheet on which the toned image is transferred reaches to the fixing devices 20. Subsequently, the fixing temperature is maintained at a suitable value by means of a control device (not shown). The heater 21 is composed of a resilient zigzag shaped-wire extending along the record sheet feed path. Such zigzag shaped-wire can absorb its thermal expansion by its resilient bent portion and hence is prevented from being hung down.

After the fixing operation, the record sheet is discharged onto the copy discharge tray 13 by means of a pair of discharge rollers 60, 61. In the record sheet feed path between the fixing device 20 and the discharge rollers 60, 61 is arranged a record sheet detecting sensor 62 for detecting jam of the record sheet.

As soon as the electric source switch 7 shown in FIG. 1 is made ON, either one or both pairs of feed rollers 57, 58 and discharge rollers 60, 61 become normally rotated.

After the transfer step, the photosensitive drum 14 is further rotated to repeat the developing and transfer steps only, and as a result, a desired number of copies, in the present embodiment, at most 20 copies may be obtained on the basis of the same electrostatic latent image once produced on the photosensitive drum 14. In the case of obtaining a plurality of copies from one manuscript, the cleaning brush 16 is separated from the photosensitive drum 14 and the erasion lamp 15, manuscript illuminating fluorescent lamp 28 and corona discharge device 34 are kept under their inoperative condition. In the present embodiment, the manuscript illuminating fluorescent lamp 28 is made ON during a period from starting of the feed of the manuscript to the end of one rotation of the photosensitive drum 14. Immediately after the last transfer step of the final copy of the desired number of copies, the cleaning brush 16 is brought into contact with the photosensitive drum 14 and the erasion lamp 15 is made ON. As a result, the toner particles and electrostatic latent image remained on the photosensitive drum 14 are erased so as to ready the photosensitive drum 14 for copying next sheet manuscript. In this case, if the next manuscript is not inserted into the light exposure portion 3, the photosensitive drum 14 is rotated for a given number of turns after the final transfer step and then is stopped and at the same time the rotation of the fan 17 is also stopped.

During the above mentioned step of obtaining a plurality of copies, if the next sheet manuscript is inserted into the light exposure portion 3, this sheet manuscript undergoes a preparatory operation. That is, the front end of the sheet manuscript causes the first microswitch 24 to operate and is held between the manuscript feed driving and driven rollers 25 and 26 and then causes the second microswitch 27 to operate. Then, the sheet manuscript stands still waiting for completion of the step of obtaining a plurality of copies of the preceding manuscript. The final transfer step of obtaining a plurality of copies of the preceding manuscript is completed and then the toner particles and the electrostatic latent image remained on that part of the photosensitive drum 14 at which the transfer step has been effected are erased by the cleaning brush 16 and erasing lamp 15.

If this cleaned portion arrives at the corona discharge device 34, it becomes operated to uniformly charge the photosensitive drum 14. Meanwhile, the next sheet manuscript standing ready for its feed operation is fed by the manuscript feed driving and driven rollers 25 and 26 such that the next sheet manuscript passes over the stage glass 29 is synchronism with that movement of the uniformly charged portion of the photosensitive drum 14 which arrives at the position opposite to the projection optical system 30. As a result, the next sheet manuscript is scanned by the exposing light in the same manner as described above. Thus, it is possible to obtain copies for a plurality of manuscripts without interruption. After the rear end of the preceding manuscript arrives at the light exposure portion 3, the operator can insert the next manuscript with a sufficient time margin.

In the present embodiment, the dial 8 for determining the number of copies shown in FIG. 1 is of fixed one which is not automatically returned to its original position and the number of copies set beforehand is memorized in the apparatus at substantially the same time as the starting of the copying step. As a result, if in the case of obtaining a plurality of copies from a plurality of manuscripts it is desired to change the number of copies from a next manuscript, it is possible to set the number of copies of the next manuscript when the next manuscript is waiting for its feed operation at the light exposure portion 3 or when the copies of the preceding manuscript are being prepared.

If the dial 8 for determining the number of copies is set to that number which is larger than a desired number and the step of obtaining a plurality of copies has been started, the top button 9 shown in FIG. 1 is pushed when the step of obtaining the copy corresponding to the desired numbers of copies is just started. Then, after the end of this step of obtaining this copy the just desired number of copies are obtained.

As can be seen from the above, in the electrographic apparatus according to the present embodiment, if the electric source switch 7 is made ON and the preparatory operation which requires a rotation of the photosensitive drum 14 by one turn is completed, then it is possible to obtain one copy everytime the photosensitive drum is rotated by one turn. If in the case of obtaining respective one copy from a plurality of manuscripts the manuscript from the second one is inserted into the light exposure portion 3 before the end of one turn of the photosensitive drum 14 for the preceding manuscript, the manuscript from the second one once assumes a wait attitude and is fed as soon as the preceding manuscript completes its one turn to start the step of obtaining copies. As a result, in this case also it is possible to obtain copies without interruption. In this way, in the case of obtaining one copy, if the next manuscript is inserted into the light exposure portion after one turn of the photosensitive drum 14 for the preceding manuscript, the copying step of this next manuscript is started when the front end thereof causes the second microswitch 27 to operate. In the case of obtaining a plurality of copies from a plurality of manuscripts, respectively, if the next manuscript is inserted into the light exposure portion 3 after the final copying step for the preceding manuscript, the copying step for this manuscript is started when the front end thereof causes the second microswitch 27 to operate.

The above mentioned electrographic apparatus is capable of obtaining any desired number of copies by passing the sheet manuscript only one time along the rectilinear short feed path. As a result, the apparatus is simple in copying operation and an opportunity of damaging a valuable manuscript becomes extremely small. In the case of obtaining one copy and a plurality of copies from a plurality of sheet manuscripts, respectively, it is possible to obtain such number of copies without interruption, so that the apparatus is extremely high in efficiency.

Figure 3:
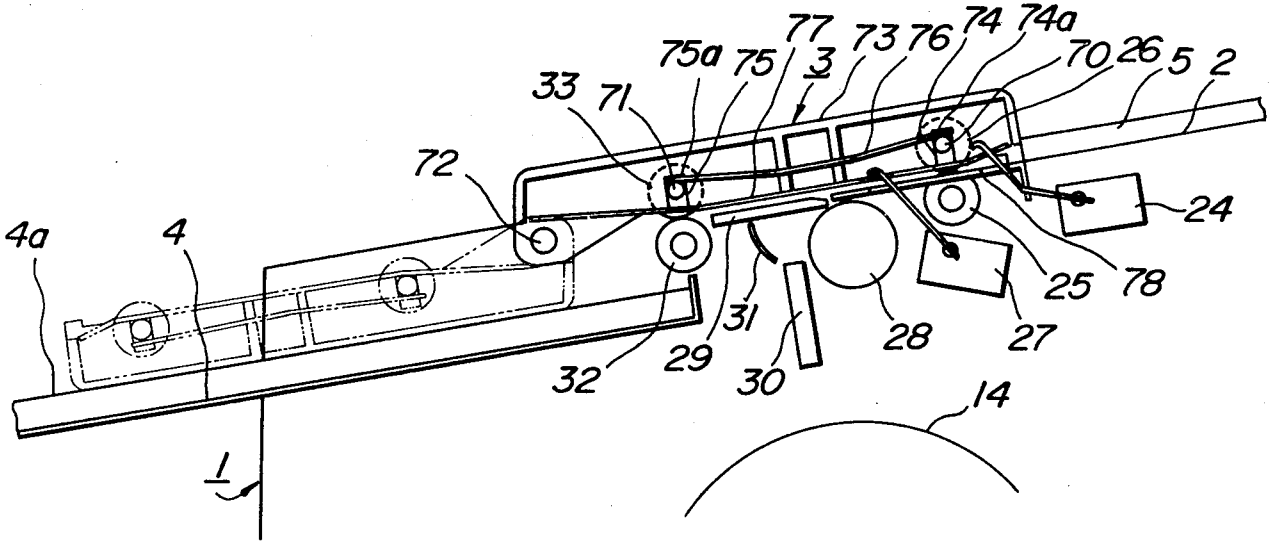
FIG. 3 is a diagrammatic cross-sectional view showing in detail the light exposure portion shown in FIG. 2.

FIG. 3 shows the light exposure portion 3 shown in FIGS. 1 and 2 in greater detail. The manuscript feed driving roller 25 is composed of a plurality of spaced apart large diameter rollers to be described later and rotatably journaled in the main body 1 and connected through a clutch mechanism (not shown) to a driving system. The manuscript discharge driving roller 32 is also rotatably journaled in the main body 1, but is directly connected to the driving system with the clutch mechanism omitted. As described above, if the electric source switch 7 (FIG. 1) is made ON, the roller 32 becomes normally rotated.

The manuscript feed driven roller 26 and discharge driven roller 33 are composed of a plurality of rollers rotatably mounted on roller shafts 70 and 71, respectively. The roller shafts 70 and 71 are slidably engaged with bearing grooves 74 and 75 provided in a supporting body 73 which is rotatably mounted through a supporting shaft 72 on the main body 1. In the embodiment shown in FIG. 3, the supporting body 73 is composed of a rectangular casing open at its lower end and closed by an upper side manuscript guide member 77. The manuscript feed driven roller 26 and discharge driven roller 33 are urged against the manuscript driving roller 25 and discharge driving roller 32 by means of a leaf spring 76 under the condition shown in FIG. 3.

The supporting shaft 72 is located substantially on an extension line drawn from a rectilinear manuscript feed path formed by the manuscript feed driving and driven rollers 25 and 26 and manuscript discharge driving and driven rollers 32 and 33. The manuscript discharge tray 4 is provided with an edge **4*a* located at a position which is lower than the above mentioned extension line from the manuscript feed path by the thickness of the supporting body 73. As a result, if the supporting body 73 is rotated about the supporting shaft 72 through substantially 180° to dispose it on the edge 4*a* of the manuscript discharge tray 4 as shown by dot and dash lines in FIG. 3, the manuscript feed driven roller 26 and discharge driven roller 33 are substantially aligned with the extension line drawn from the manuscript feed driving roller 25 and discharge driving roller 32** to provide a thick manuscript feed path to be described later.

The supporting shaft 72 and bearing members of the supporting body 73 rotatably supported by the supporting shaft 72, are divided into two parts which are spaced apart from each other as viewed in a direction perpendicular to the manuscript feed direction by a distance which is sufficient to permit the thick manuscript to pass therethrough. In the position shown by full lines in FIG. 3, the supporting body 73 is closed at its lower surface by the upper side manuscript guide member 77 which is spaced apart from the stage glass 29 and from a lower side manuscript guide member 78 provided near the manuscript feed driving roller 25 to form a gap for defining the sheet manuscript feed path. The manuscript feed driven roller 26 and discharge driven roller 33 are projected from the upper side manuscript guide 77, so that in the position of the supporting body 73 shown by dot and dash lines in FIG. 3 the upper side manuscript guide 77 functions to prevent the roller shafts 70 and 71 from removing out of the bearing groove 74 and 75, respectively. The lower surface of the upper side manuscript guide member 77, that is, the surface opposed to the projection optical system 30 when the supporting body 73 is located at the position shown by full lines in FIG. 3 is provided at least on that range which corresponds to the effective picture surface of the projection optical system 30 with a white color painted portion having a reflecting power which is the same as that of a manuscript which is substantially white in color. The depth of the bearing grooves 74 and 75 from the upper side manuscript guide 77 to respective bases **74*a* and 75*a* are determined such that in the case of feeding the thick manuscript with the supporting body 73 located at the position shown by dot and dash lines in FIG. 3, even if the manuscript feed driven roller 26 and discharge driven roller 33 are pushed downwardly against the action of the lead spring 76, these rollers 26 and 33 are slightly projected from the upper side manuscript guide 77**.

The thick manuscript feed mechanism for the electrographic apparatus according to the invention will now be described in greater detail with reference to FIGS. 4, 5 and 6.

Figure 5:
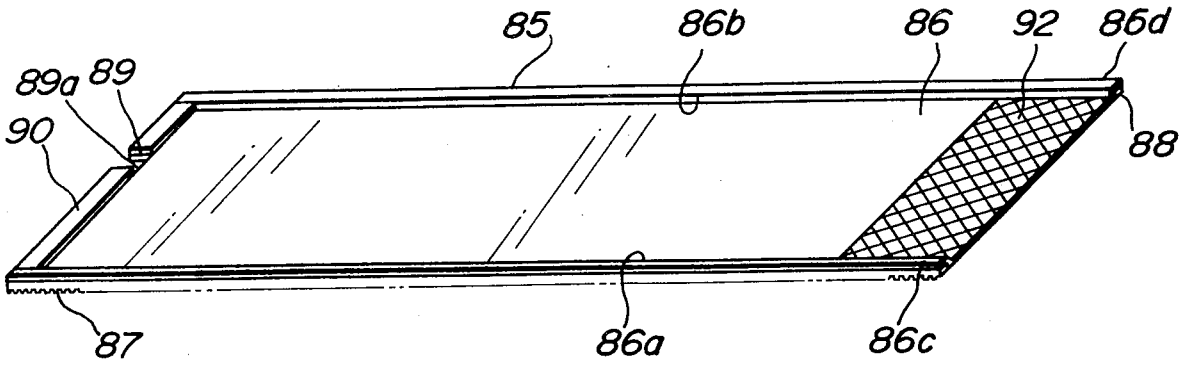
FIG. 5 is a perspective view of one embodiment of a thick manuscript carriage used in the case of obtaining copies of the thick manuscript by the electrographic apparatus according to the invention.

FIG. 5 shows the supporting body 73 rotated about the supporting shaft 72 and disposed, inside out, on the edge **4*a* of the manuscript discharge tray 4 so as to obtain copies of the thick manuscript. FIG. 5 shows one embodiment of the thick manuscript carriage adapted to dispose the thick manuscript thereon and carry it. FIG. 6 shows the mode of the thick manuscript carriage during its feeding on the manuscript feed driving roller 25**.

In the case of obtaining copies of a thick manuscript, the sheet manuscript edge guide 5 is rotated around its longitudinal axis to expose a thick manuscript edge guide 80. A method of changing over the edge guides 5 and 80 one from the other will be described in greater detail. By means of these edge guides 5 and 8 both sheet and thick manuscripts are properly positioned at their side edge when these sheet and thick manuscripts are inserted into the light exposure portion 3.

The manuscript feed driving roller 25 is composed of several short rubber rollers 25*b* spaced apart from each other and secured to a driving shaft 25*a* rotatably journaled in the main body 1 and a pair of thick manuscript feed pinion gears 81 and 82 secured to those portions of the driving shaft 25*a* which lie outside the rubber rollers 25*b*. The total length of the group of rubber rollers 25*b* is made one which is sufficient to feed a sheet manuscript having a maximum copy with allowable by the electrographic apparatus according to the present invention. The pinion gears 81 and 82 are arranged at those positions which do not prevent passage of the above mentioned sheet manuscript having the maximum copy width.

The pinion gears 81 and 82 each has a pitch circle whose diameter is equal to a diameter of the rubber roller 25*b*. That is, if the thick manuscript is disposed on the thick manuscript carriage shown in FIG. 5 and fed, the speed of the thick manuscript is made equal to the feed speed of the sheet manuscript and to the peripheral speed of the photosensitive drum 14 (FIG. 2). In addition, the pinion gears 81 and 82 are secured to the driving shaft 25*a* such that respective gear teeth are aligned with each other.

A part of the outer periphery of each of the rubber rollers 25*b* for constituting the manuscript feed driving roller 25 is projected from the upper surface of the lower side manuscript guide 78 through a window 78*a* provided thereon. The pinion gears 81, 82 are also projected such that the upper end of a tooth base circle of the pinion gears 81, 82 is aligned with the upper surface of the lower side manuscript guide 78 or is made slightly higher than the latter. The rear end of the window 78*a* as viewed in the feed direction of the manuscript is slightly bent downwardly or chamfered for the purpose of preventing the front end of the sheet manuscript from engaging with the rear end of the window 78*a*.

The lower side manuscript guide 78 is provided at its center part with a window 78*b* through which are projected actuators 24*a* and 27*a* of the first and second microswitches 24 and 27, respectively.

The upper surface of the stage glass 29 is substantially aligned with the upper surface of the lower side manuscript guide 78. Between the upper surface of the stage glass 29 and the lower surface of the upper side manuscript guide 77 is formed the sheet manuscript feed path along which the sheet manuscript is fed. The upper surface of the stage glass 29 is located at a position which substantially coincides with an object surface, that is, a surface conjugate to an image surface of the projection optical system 30, more particularly, within a depth of field at the object side (preferably in the depth at a position nearer to the surface of the photosensitive drum 14). That is, the upper surface of the stage 29 is located at such position that in the case of copying a sheet manuscript there is no risk of out of focus even when the sheet manuscript is raised from the upper surface of the stage glass 29 and fed along the lower surface of the upper side manuscript guide 77 and that in the case of copying a thick manuscript there is no risk of out of focus even when the thick manuscript is disposed on the thick manuscript carriage shown in FIG. 5 and fed along a path which is higher than the sheet manuscript path by the thickness of the thick manuscript carriage. In order to prevent the front end of the sheet manuscript from catching the stage glass 29, that edge 29*a* of the stage glass 20 with which the manuscript makes at first contact is chamfered. In addition, the stage glass 29 is detachably mounted on the main body 1 so as to clean the illumination fluorescent lamp 28, projection optical system 30, reflecting mirror 31 or the like arranged below the stage glass 29.

The manuscript feed driven roller 26 is opposed to the rubber roller 25*b* of the manuscript feed driving roller 25 and projected through a window 77*a* provided in the upper side manuscript guide 77. The manuscript discharge driven roller 33, like the manuscript feed driven roller 26, is also composed of a plurality of short-rollers each projected through a window 77*b* provided in the upper side manuscript guide 77. The upper side manuscript guide 77 is provided with a window 77*c* at that portion which corresponds to the window 78*b* provided in the lower side manuscript guide 78.

The front and rear edges of the upper side manuscript guide 77 as viewed in the manuscript feed direction are so inclined that the sheet and thick manuscripts can be fed in a smooth manner.

Figure 4:
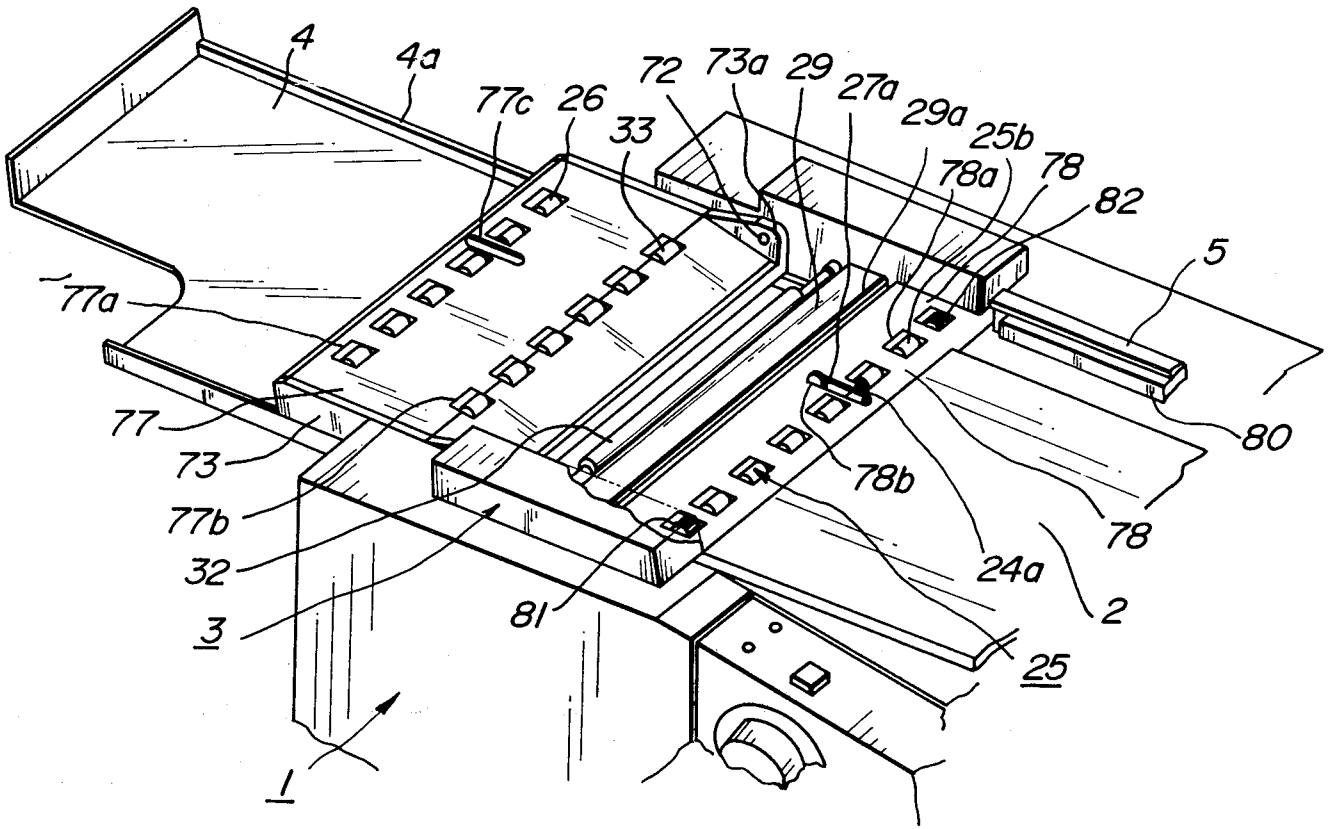
FIG. 4 is a perspective view showing the supporting body shown in FIG. 3 and rotated by 180° so as to form a rectilinear manuscript feed path used in the case of obtaining copies of a thick manuscript.

A bearing portion 73*a* for rotatably supporting the supporting body 73 and the supporting shaft 72 are located outside the extension line drawn from the thick manuscript edge guide 80 as shown in FIG. 4 so as to allow the feed of the thick manuscript carriage to be described later.

The thick manuscript carriage will now be described in greater detail with reference to FIGS. 5 and 6. In the present embodiment, a thick manuscript carriage 85 is composed of a light transmissive plate 86 adapted to dispose a thick manuscript thereon, raised edges 86*a* and 86*b* provided at both sides of the light transmissive plate 86 and opposed in widthwise direction thereof and rack supporting edges 86*c* and 86*d* extending in parallel with the light transmissive plate 86 and made integral with the raised edges 86*a* and 86*b*, respectively. All of these plate and edges are formed of transparent plastics having a uniform thickness and made integral into one body. The rack supporting edges 86*c* and 86*d* are provided at their lower surfaces with racks 87 and 88 with their teeth facing downwardly, respectively.

The light transmissive plate 86 has a thickness t which is sufficiently thick to make it mechanically rigid and geometrically flat and is sufficiently thin to maintain a manuscript surface within a range of the depth of field of the projection optical system 30 even when the manuscript surface is raised from the upper surface of the stage glass 29 by an optical thickness of t/n where n is the refractive index of the light transmissive plate 86. Such light transmissive plate 86 may be formed of a transparent acryl plate having a thickness of 1 mm.

The distance between the opposed raised edges 86*a* and 86*b*, that is, the width of the light transmissive plate 86 is of one which permits a thick manuscript having a maximum copy width allowable by the electrographic apparatus according to the invention to be disposed thereon.

The light transmissive plate 86 is provided at one of ends in the lengthwise direction thereof with a raised end edge 90 for determining the position of the front end of the thick manuscript in its feed direction. The raised end edge 90 is partly broken away to form a notch 89.

The notch 89 is located at a position which corresponds to the actuators 24*a* and 27*a* of the first and second microswitches 24 and 27 and the base 89*a* of the notch 89 is aligned with the front end of the thick manuscript which makes contact with the raised end edge 90. The height of the raised end edge 90 is so determined that when book, for example, is disposed open on the light transmissive plate 86 its thick cover does not make contact with the raised end edge 90.

The teeth of the racks 87 and 88 are aligned with each other in a direction perpendicular to the lengthwise direction of the light transmissive plate 86. The total length of the racks 87 and 88 is determined such that the racks 87 and 88 engage with the pinion gears 81 and 82, respectively, until the rear end of the thick manuscript having a maximum copy length allowable by the apparatus according to the invention has passed through the effective picture surface of the projection optical system 30.

The height of the teeth of the racks 87 and 88 is so determined that the pitch line thereof is aligned with the lower surface of the light transmissive plate 86.

Figure 6:
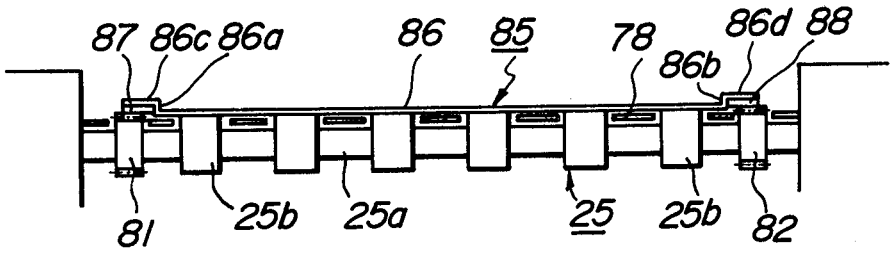
FIG. 6 is a front elevational view showing a relation between the thick manuscript carriage shown in FIG. 5 and a manuscript feed driving roller and pinion gears shown in FIG. 4, partly shown in section.

As shown in FIG. 6, if the thick manuscript carriage 85 is disposed on the manuscript feed driving roller 25 so as to bring the racks 87 and 88 into engagement with the pinion gears 81 and 88 provided at both ends of the manuscript feed driving roller 25, a contact line between the rubber roller 25*b* of the manuscript feed driving roller 25 and the lower surface of the light transmissive plate 87 is aligned with the pitch line where the pinion gears 81 and 82 engage with the racks 87 and 88, respectively. As a result, the peripheral speed of the rubber roller 25*b* is equal to that of the pitch circle of the pinion gears 81, 82, so that the thick manuscript carriage 85 is smoothly fed at a given speed.

If the racks 87 and 88 are formed of plastic molding obtained by the same mold, it is possible to align these teeth by merely aligning one end of the racks 87 and 88 with the end of the rack supporting edges 86*c* and 86*d*. In addition, the thick manuscript carriage 85 composed of the light transmissive plate 86, racks 87, 88, notch 89 and raised end edge 90 may be made of transparent plastics and made integral into one body.

The operation of obtaining copies of a thick manuscript by means of the above mentioned thick manuscript carriage 85 will now be described with reference to FIGS. 2 to 6.

In the first place, a thick manuscript to be copied is disposed on the light transmissive plate 86 of the thick manuscript carriage 85 with the manuscript surface faced downwardly and the front and side edges of the manuscript are brought into contact with the raised end edge 90 and side edge 86*b*, respectively. Then, the thick manuscript is urged against the thick manuscript carriage 85 such that the thick manuscript is closely contact with substantially total surface of the light transmissive plate 86. The thick manuscript carriage 85 is slidably moved toward the light exposure portion 3 while the side edge of the thick manuscript carriage 85, that is, the side edge of the rack 88 slightly makes contact with the thick manuscript edge guide 80.

If the thick manuscript carriage 85 arrives at the light exposure portion 3, the base 89*a* of the notch 89 causes the actuator 24*a* of the first microswitch 24 to be pushed, thereby starting the rotation of the manuscript feed driving roller 25. Then, the racks 87 and 88 are brought into engagement with the pinion gears 81 and 82, respectively, thereby starting the feed of the thick manuscript carriage 85.

If the pinion gears 81, 82 cause the thick manuscript carriage 85 to be fed the base 89*a* of the notch 89 is urged against the actuator 27*a* of the second microswitch 27, thereby once stopping the feed of the carriage 85. Then, similar to the above described operation of obtaining copies of the sheet manuscript, the carriage 85 is fed again after a predetermined time has elapsed. At the same time, the manuscript illuminating fluorescent lamp 28 is made ON to project the image of the thick manuscript disposed on the thick manuscript carriage 85 through the stage glass 29 and projection optical system 30 onto the photosensitive drum 14.

The front end of the thick manuscript carriage 85 which has passed over the stage glass 29 rides on the manuscript discharge driving roller 32 and is fed thereby. At this time, the rear half-portion of the thick manuscript is still scanned by the exposing light. As described above, the thick manuscript feed path composed of the manuscript feed driving roller 25, manuscript discharge driving roller 32, manuscript discharge drive roller 33 and manuscript feed driven roller 26 makes one flat plane, so that the thick manuscript carriage 85 is effectively fed along this thick manuscript feed path. As a result, the thick manuscript disposed on the thick manuscript carriage 85 is not deviated from the depth of field of the projection optical system 30 and hence is effectively projected onto the photosensitive drum 14.

As described above, the thick manuscript carriage 85 is fed by mutual engagement between the racks 87 and 88 on the one hand and the pinion gears 81 and 82 on the other hand. As a result, if the thick manuscript carriage 85 is urged against the thick manuscript feed path under a pressure which is sufficient to prevent disengagement between the racks and the pinion gears, it is possible to feed the thick manuscript carriage 85 in an extremely positive manner. In addition, the engagements between the racks 87, 88 and the pinion gears 81, 82 are effected at the left and right sides with respect to the feed direction of the thick manuscript carriage, and the feed speeds at the left and right sides of the thick manuscript carriage are equal with each other, so that there is no risk of the thick manuscript carriage being inclined during its feed. The thick manuscript carriage 85 may be urged against the thick manuscript feed path under a pressure which is sufficient to prevent the thick manuscript from floating, as in the case of the conventional copying machines. As a result, in the case of obtaining copies of a thick manuscript by means of the electrographic apparatus according to the present invention, the operator can urge the thick manuscript against the thick manuscript carriage 85 for the purpose of preventing the thick manuscript from floating up and feed the carriage 85 in conformity with the operation of the electrographic apparatus, thereby effecting the copying operation in a positive manner.

The above mentioned electrographic apparatus is capable of obtaining any desired number of copies of a manuscript by scanning it only one time by an exposing light. Therefore, the apparatus as a whole is made light tight such that the electrostatic latent image produced on the photosensitive drum 14 is effectively maintained, that is, the surface of the photosensitive drum 14 is prevented from being illuminated with any exterior light during a step of obtaining a plurality of copies. This light tight property of the apparatus can effectively be maintained when copies of a sheet manuscript are obtained by the supporting body 73 covering the light exposure portion 3. But, in the case of obtaining copies of a thick manuscript, the supporting body 73 is rotated about the supporting shaft 72 to the position shown by dot and dash lines in FIG. 3. As a result, after the passage of the thick manuscript an exterior light may pass through the projection optical system 30 without hindrance. As a result, there is a risk of the electrostatic latent image once produced on the photosensitive drum 14 being erased by the incident exterior light. In practice, any exterior light on the order of indirect indoor illumination light does exert substantially no adverse effect upon the electrostatic latent image, but a light source, etc., for indoor illumination arranged directly above the electrographic apparatus does exert a remarkably adverse effect upon the electrostatic latent image.

The present embodiment can provide a plurality of copies from a thick manuscript even under the above mentioned condition.

For this purpose, when a thick manuscript disposed on the thick manuscript carriage has been completely scanned by the exposing light, the front end of the thick manuscript carriage 85 is made contact with a stopper **4*b* provided at a front end of the manuscript discharge tray 4 to stop the feed of the thick manuscript carriage 85. Moreover, the rear end portion of a light transmissive plate 86 of the thick manuscript carriage 85 is provided at that portion which is opposed to the stage glass 29 under the above described condition with a light interruptive portion 92** formed by a light interruptive treatment such as a black paint coating.

As a result, after the thick manuscript 91 has been scanned by the exposing light, the light interruptive portion 92 functions to interrupt an incident of exterior light onto the photosensitive drum 14. If this condition is maintained until a step of obtaining a plurality of copies is completed, the electrostatic latent image produced on the photosensitive drum 14 is effectively maintained, thereby obtaining any desired number of copies without deteriorating their picture quality. If the stopper **4*b* is too high, there is a risk of the stopper 4*b* being struck by the thick cover of books, etc., and of the manuscript being displaced. Therefore, the height of the stopper 4*b* is made slightly higher than the thick manuscript carriage 85**.

The under surface of the light transmissive plate 86 is provided at an area outside the light interruptive portion 92 and outside a portion on which the thick manuscript 91 is disposed with a reflective portion painted with white color having substantially the same reflection factor as that of white part of a manuscript, which can avoid an undesired adhesion of toner to a portion of the photosensitive drum 14 and a record paper not corresponding to the black portion of the manuscript.

As stated hereinbefore, the electrographic apparatus according to the present embodiment has a number of advantages. In the first place, the apparatus is simple and compact in construction. Secondly, it is possible to obtain a plurality of copies of a sheet manuscript and thick manuscript by scanning such manuscript one time only by an exposing light, so that the apparatus can be manipulated with a high efficiency. Third, the use of substantially rectilinear manuscript feed path, and the production of a plurality of copies by one time exposure of light ensure an extremely small rate of damaging the sheet manuscript. Fourth, since the manuscript feed path can easily be made open by rotating the supporting body 73, it is possible to confine the damage of the sheet manuscript to the minimum even when the light exposure portion 3 is clogged with the sheet manuscript. Fifth, since the combination of steps of obtaining copies renders it possible to effect the copying operation without interruption, particularly in the case of obtaining copies of a sheet manuscript the manuscript treatment becomes considerably high in efficiency if compared with the conventional electrographic apparatus for mainly obtaining copies of the thick manuscript. Sixth, even in the case of obtaining copies of the thick manuscript, the thick manuscript can be fed in a simple and precise manner and it is possible to obtain a plurality of copies by scanning the thick manuscript by one time only by the exposing light in the same manner as in the case of the sheet manuscript, whereby the apparatus can easily be operated in the same manner as the conventional electrographic apparatus for mainly obtaining copies of the thick manuscript in general.

Figure 7A:
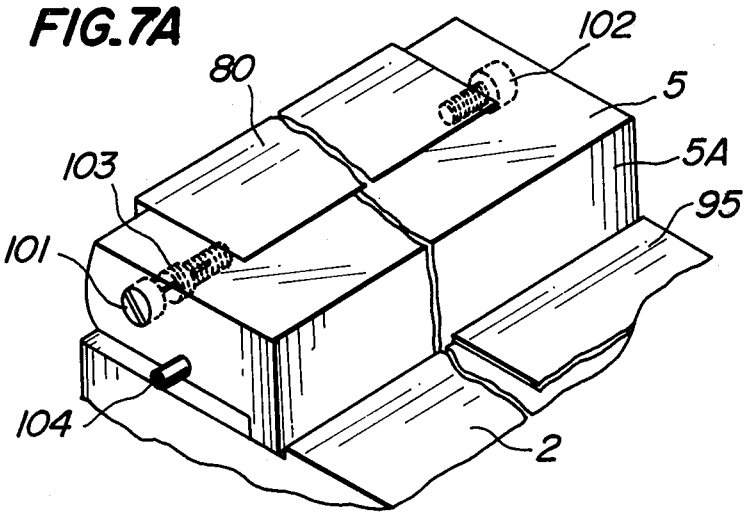
FIGS. 7A, 7B and 8A, 8B and 9A, 9B are perspective views, cross-sectional views and side views showing an embodiment of the automatic changing mechanism of edge guides according to the invention.
Figure 7B:
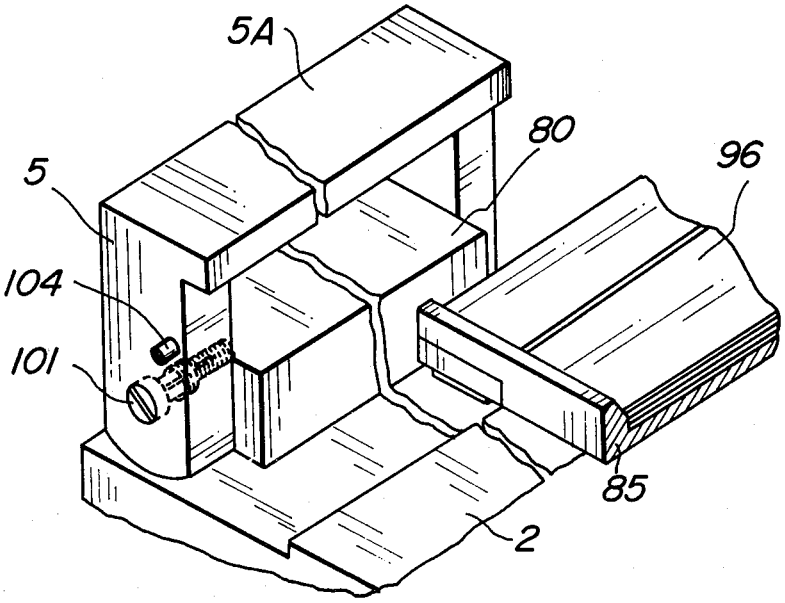
Figure 8A:
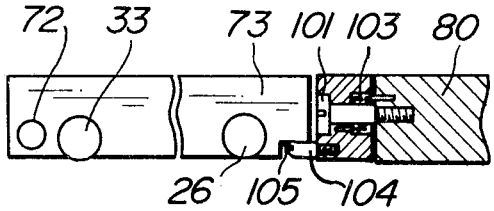
Figure 8B:
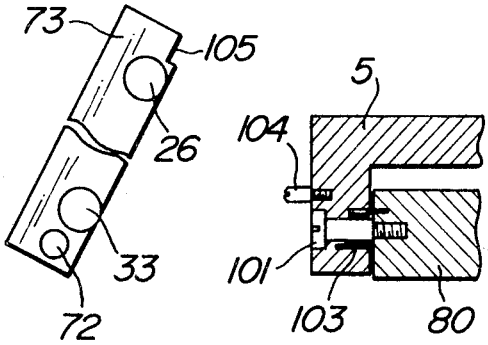
Figure 9A:
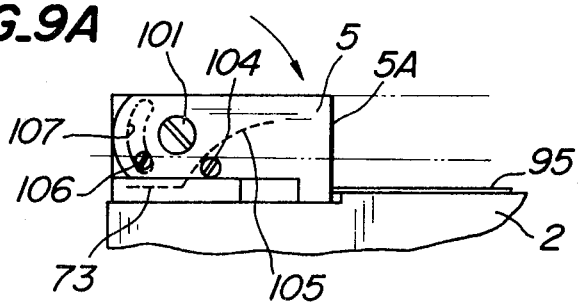

FIGS. 7A and 7B are perspective views showing an embodiment of a mechanism for changing edge guides 5 and 80 in an electrographic apparatus according to the present embodiment, in which FIG. 7A shows a case of copying a sheet manuscript 95 and FIG. 7B shows a case of copying a thick manuscript 96 disposed on a thick manuscript carriage 85. The edge guide 80 for determining a position of a side edge of the thick manuscript carriage 85 is fixed to the main body 1 while the edge guide 5 for determining a position of a side edge of the sheet manuscript 95 is provided so as to rotate the edge guide 80 about axes 101 and 102. The axis 101 is provided with a coil spring 103, by which the edge guide 5 for a sheet manuscript is biased so as to rotate as shown in FIG. 7B. A pin 104 is provided on a side surface of the edge guide 5 that is opposed to the manuscript feed mechanism. The pin 104 is, as shown in FIG. 8A, engaged with a curved recess 105 formed at a front edge of the supporting body 73 supporting the upper feed mechanism as shown in FIG. 8A. Therefore, when the supporting body 73 for the upper feed mechanism is closed, the engagement of the pin 104 with the curved recess 104 rotates the edge guide 5 against the force of the spring 103 as shown in FIGS. 7A and 8A, whereby a surface 5A of the edge guide 5 determines a position of the side edge of the sheet manuscript 95 and guides it as shown in FIG. 9A. The weight of the upper feed mechanism including the supporting body 73 is made so heavy that the upper feed mechanism can press down the edge guide 5 against the force of the spring 103. If the weight of the upper feed mechanism is deficient, it is impossible to normally hold and transport the sheet manuscript 95 by driving rollers 25 and 32 between them and driven roller 26 and 33. The edge guide 5 should be constructed such that it protrudes below the top surface of the manuscript carriage 2 as clearly shown in FIGS. 7A and 9A, by which the sheet manuscript 95 is not held between the manuscript carriage 2 and the edge guide 5.

Figure 9B:
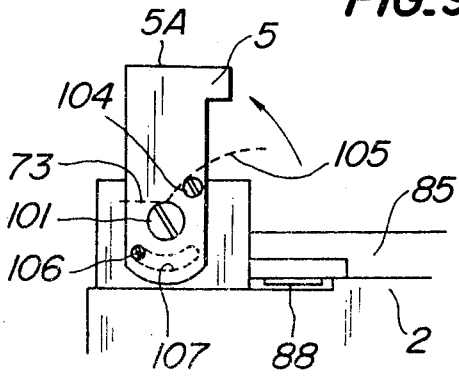

In the case of copying the thick manuscript 96, the supporting body 73 of the upper feed mechanism is rotated about the shaft 72. This rotation of the supporting body 73 rotates the edge guide 5 about the axes 101 and 102 with the aid of the force of the spring 103, by which the surface 5A of the edge guide 5 for a sheet manuscript comes off the manuscript carriage 2 and the edge guide 80 for guiding the thick manuscript carriage 85 is exposed. The thick manuscript carriage 85 is guided with its side edge being in contact with the exposed edge guide 80. As shown in FIG. 9B, a side surface of the edge guide 80 is provided with a pin 106 which is fit to an arcuate slot 107. The arcuate slot 107 serves as a stopper for rotation of the edge guide 5, by which the edge guide 5 does not rotate further over a perpendicular position.

When the supporting body 73 supporting the upper feed mechanism is rotated for copying the sheet manuscript 95, its curved recess 105 is brought into engagement with the pin 104, by which the edge guide 5 is rotated against the resilient force of the spring 103 to provide the condition shown in FIG. 7A.

Thus, a user merely rotates the supporting body 73 supporting the upper feed mechanism, in response to which the edge guides 5 and 80 are automatically changed over one from the other. This operation is easy and can positively prevent mis-copying which may be caused by forgetting the changing.

Figure 10:
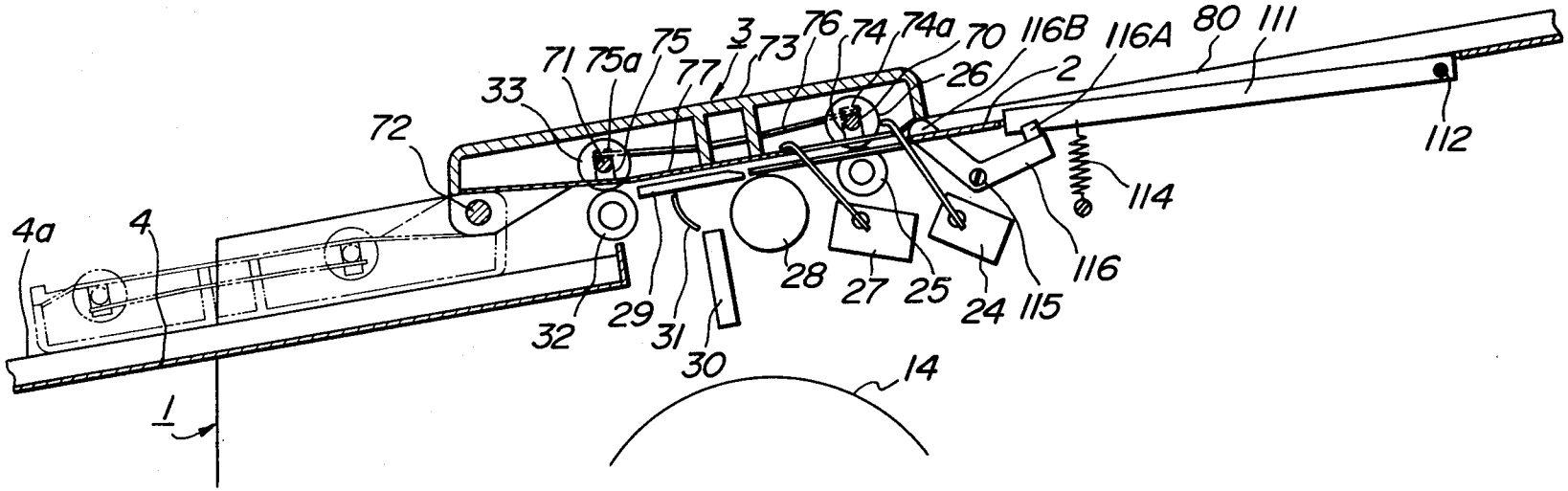
FIGS. 10 and 11 are a cross-sectional view and a perspective view, respectively, depicting another embodiment of the automatic changing mechanism of edge guides according to the invention.
Figure 11:
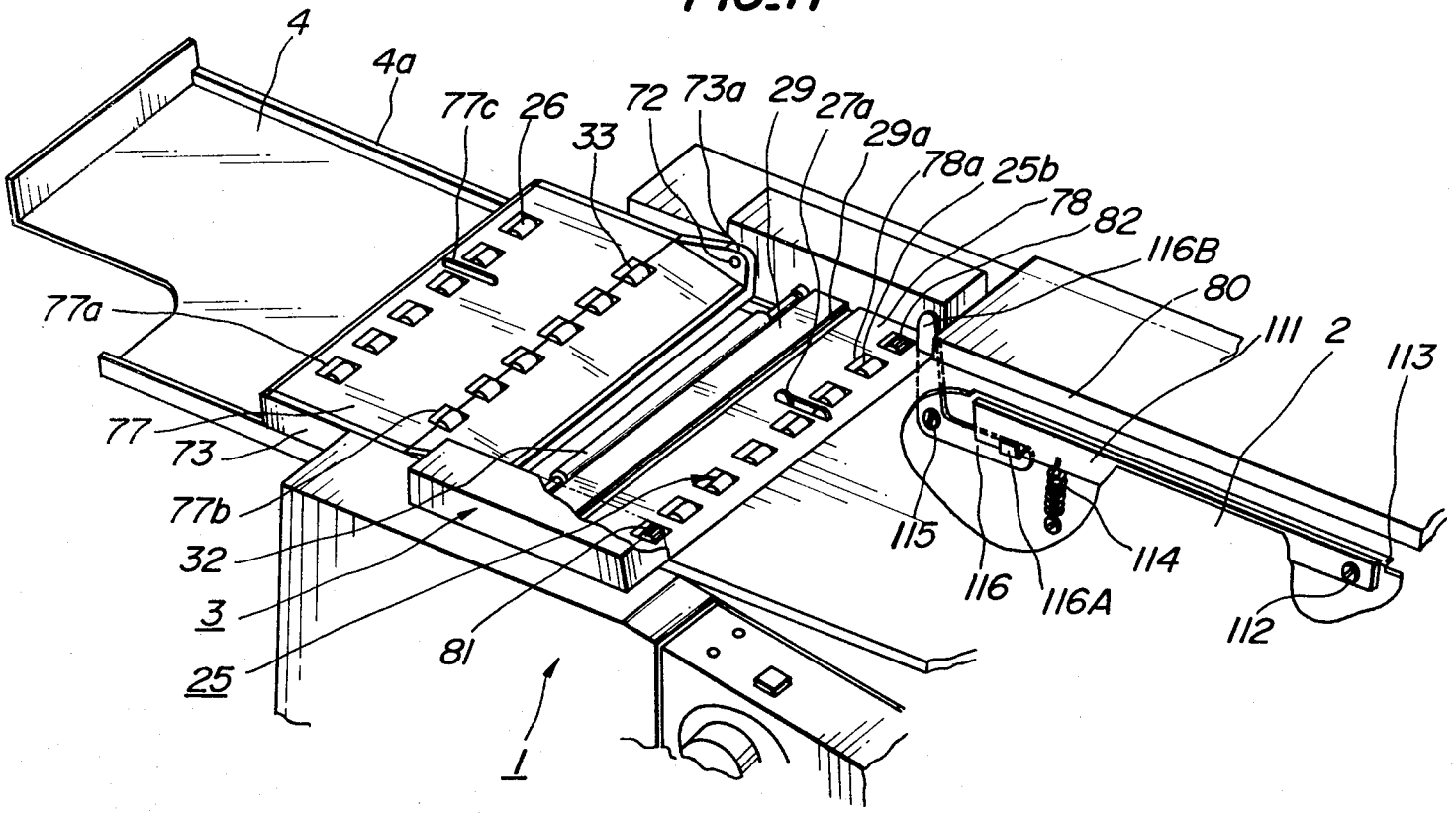

FIGS. 10 and 11 show another embodiment of the electrographic apparatus according to the invention. In this embodiment, the mechanism for changing over edge guides in response to the upper feed mechanism is different from that of the above described embodiment. Therefore, only the mechanism for changing over edge guides is described in detail hereinafter. In this embodiment, an edge guide for determining a position of a side of a sheet manuscript is provided rotatably about an axis 112. A manuscript carriage 2 is provided with an elongated hole 113 for receiving this protruding edge guide 111. A tension spring 114 is provided between the edge guide 111 and the main body of the apparatus so as to always bias the edge guide 111 downwardly. An L-shaped lever 116 is rotatably provided about an axis 115 on the main body. An end 116A of the lever 116 is engaged with the edge guide 111 and the other end 116B thereof is protruded above the manuscript carriage 2. The latter protruding end 116B of the lever 116 is pressed down, as shown in FIG. 10, by a front end of the supporting body 73 supporting the upper feed mechanism when the supporting body 73 is closed.

When a sheet manuscript is copied, the protruding end 116B of the lever 116 is pressed down, as shown in FIG. 10, by the supporting body 73 so as to rotate the edge guide 111 clockwise about the axis 112 against the force of the spring 114 and to make the edge guide 111 protrude from the hole 113 above the manuscript carriage 2. Thus, the edge guide 111 for a sheet manuscript is set. When the upper feed mechanism is rotated as shown in FIG. 11, the lever 116 is made free and the edge guide 111 is held under the top surface of the manuscript carriage 2 to expose a guiding side of an edge guide 80 for a thick manuscript carriage.

Figure 12:
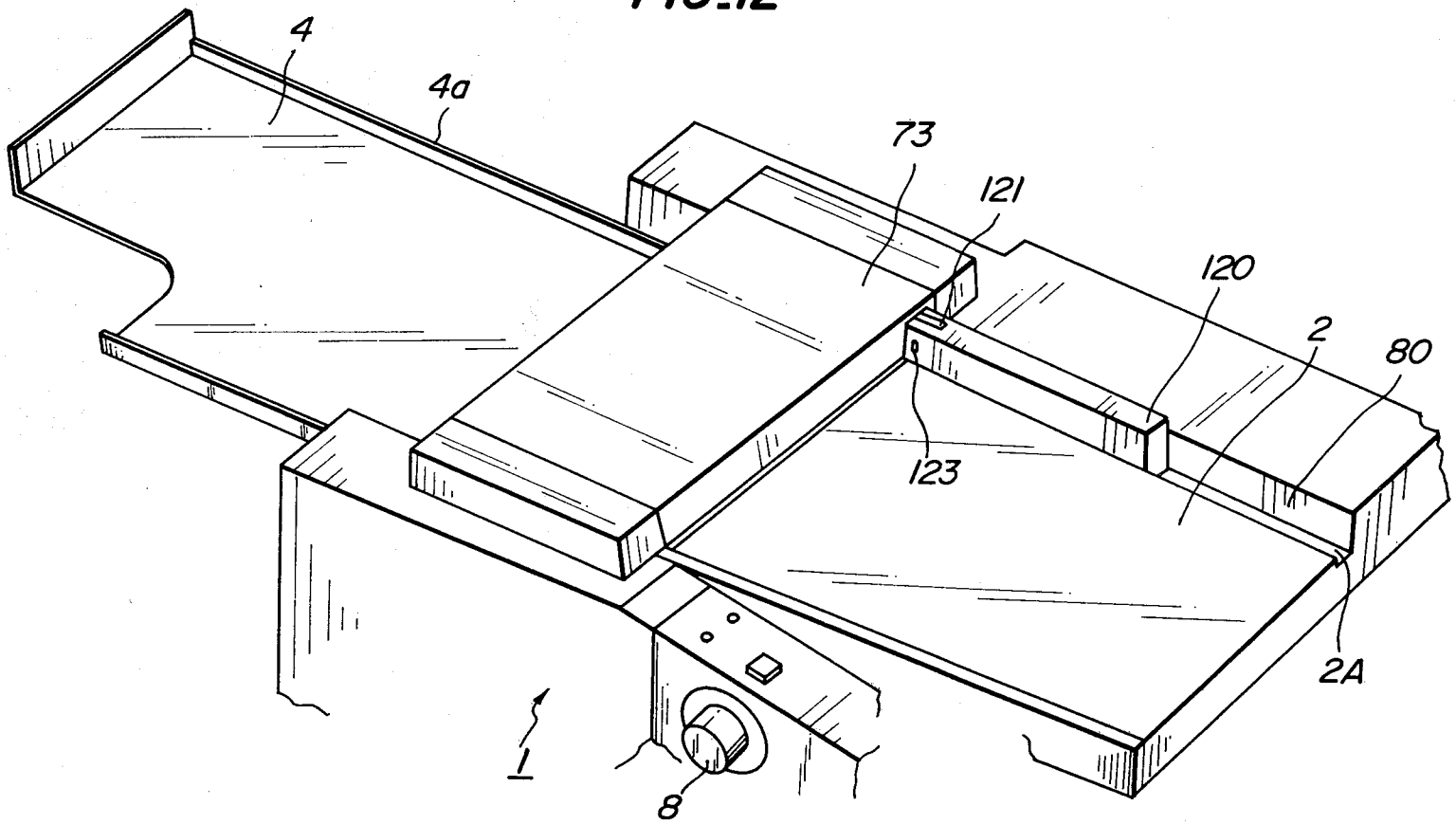
FIGS. 12–14 are a perspective view and cross sectional views showing another embodiment of the automatic changing mechanism of edge guides according to the invention.
Figure 13:
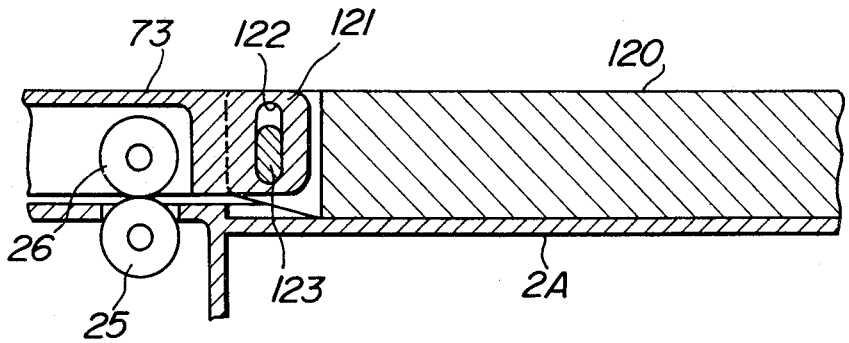
Figure 14:
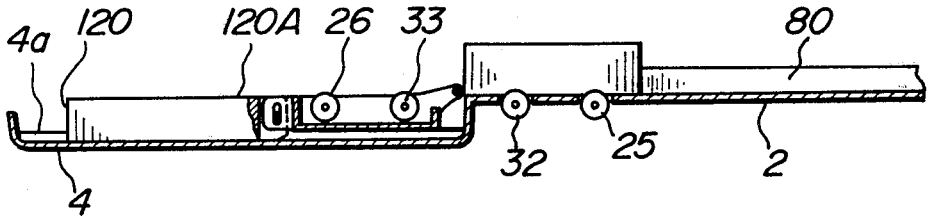

FIGS. 12, 13 and 14 show still another embodiment of the electrographic apparatus according to the invention. In this embodiment, an edge guide 120 for a sheet manuscript is attached to the supporting body 73 supporting the upper feed mechanism. A protrusion 121 is provided on the front side of the supporting body 73. The protrusion 121 is provided with an ellipsoidal hole 122 through which a pin 123 having an ellipsoidal cross section is inserted. Both the ends of the pin 123 are adhered to the edge guide 120. Therefore, the edge guide 120 is moved up and downward in a plane of drawing of FIG. 13. When a sheet manuscript is copied, the supporting body 73 for the upper feed mechanism is placed upon the lower feed mechanism so that the edge guide 120 for the sheet manuscript is inserted in a groove 2A formed along a side edge of the manuscript carriage 2 to determine a position of a sheet manuscript.

When the supporting body 73 is rotated and placed on the manuscript discharge tray 4 as shown in FIG. 14 for copying a thick manuscript, the edge guide 120 is brought under the supporting body 73 and a top surface of the edge guide 120 and a top surface 120A of the supporting body 73 are brought in one and the same plane.

Figure 15:
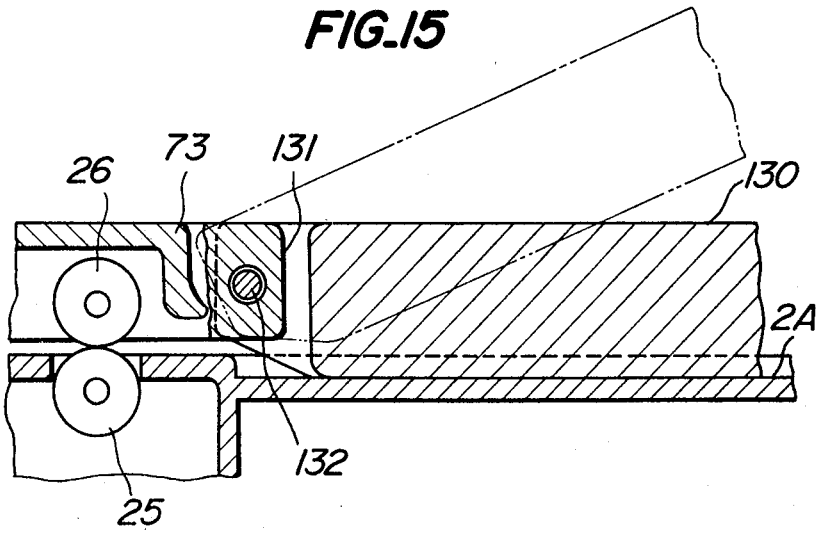
FIGS. 15 and 16 are a cross-sectional view and a perspective view, respectively, illustrating still another embodiments of the automatic changing apparatus of edge guides according to the invention.
Figure 16:
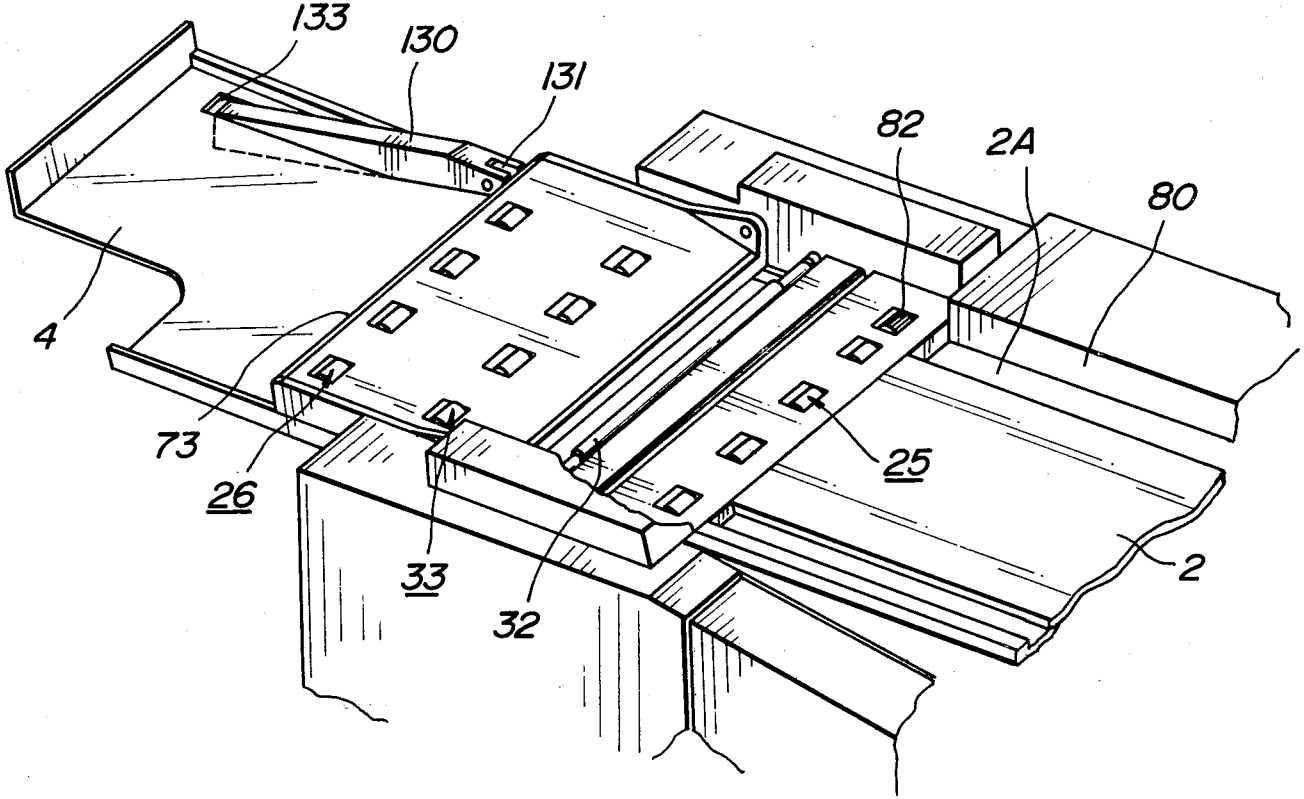

FIGS. 15 and 16 show another embodiment of the apparatus shown in FIGS. 12 to 14. In this embodiment, an edge guide 130 for a sheet manuscript is attached to the supporting body 73 of the upper feed mechanism. A pin 132 is inserted through a hole of a protrusion 131 protruding from a front edge of the supporting body 73 and both ends of the pin 132 are adhered to the edge guide 130. Thus, the edge guide 130 is rotated downward through an aperture 133 of the manuscript discharge tray 4. This prevents the edge guide 130 from protruding above the thick manuscript feed path.

Figure 17:
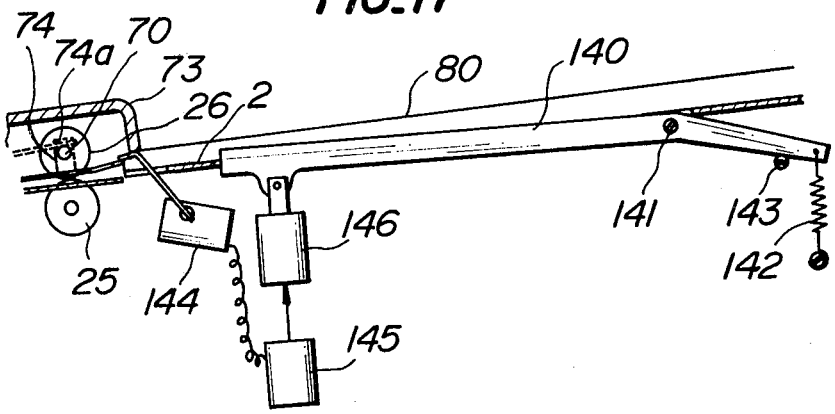
FIG. 17 is a cross-sectional view showing a still another embodiment of the automatic changing mechanism of edge guides according to the present invention.

FIG. 17 shows still another embodiment of the electrographic apparatus according to the present invention. In this embodiment, an edge guide 140 for a sheet manuscript is provided rotatably about an axis 141. Between an end of the edge guide 140 and the main body of the apparatus a tension spring is provided which rotates the edge guide 140 clockwise about the axis 141. This rotation is limited by a stopper 143. A reference numeral 144 denotes a microswitch 144 having an actuator which is driven by a front end of the supporting body 73 for the upper feed mechanism. The output of the microswitch 144 is delivered to a solenoid driving circuit 145, the output of which drives a solenoid 140 having a plunger coupled to the other end of the edge guide 140. When the supporting body 73 is closed for copying a sheet manuscript as shown in FIG. 17, the solenoid 146 is not energized so that the edge guide 140 is protruded above a top surface of the manuscript carriage 2 by the spring 142. When the supporting body 73 is made open for copying a thick manuscript, the microswitch 144 is actuated, by which the solenoid 146 is energized. Then, the edge guide 140 is rotated anticlockwise against a force by the spring 142. The edge guide 140 is rotated to or below the top surface of the manuscript carriage 2 so that an edge guide 80 for guiding the thick manuscript carriage is exposed.

Figure 18:
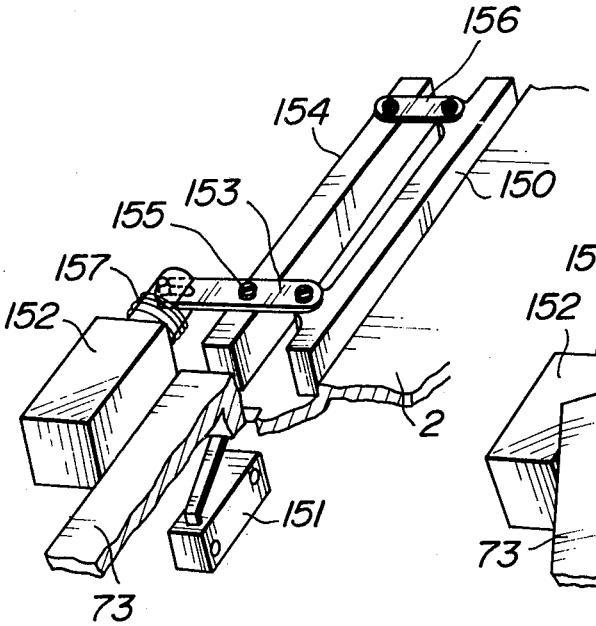
FIGS. 18 and 19 are perspective views showing still another embodiments of automatic changing mechanism of edge guides according to the invention.
Figure 19:
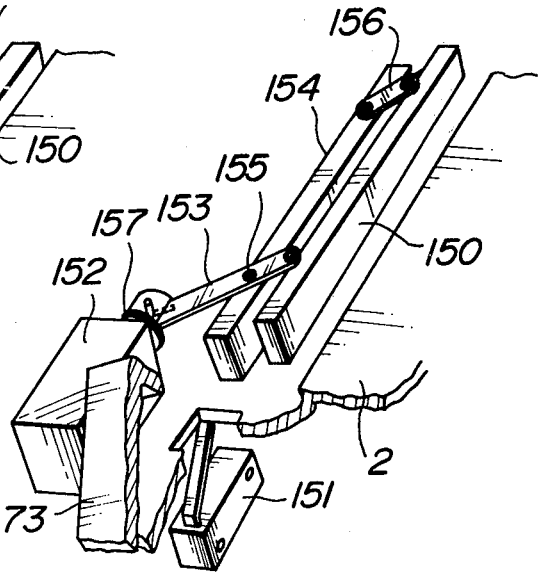

FIGS. 18 and 19 show further embodiment of the electrographic embodiment according to the present invention. In this embodiment, a single edge guide 150 is commonly used as an edge guide both for a sheet manuscript and a thick manuscript. The edge guide 150 is displaced in a parallel manner in response to a rotation of the supporting body 73 for the upper feed mechanism. A reference numeral 151 denotes a microswitch actuatable by a front edge of the supporting body 73. The actuated microswitch 151 energizes a solenoid 152. To a plunger of the solenoid 152 is pivotally provided an end of a lever 153. The lever 153 is provided rotatably about an axis 155 provided on a fixed member 154. The other end of the lever 153 is pivotally provided on the edge guide 150. There is pivotally provided a second lever 156 on and between the fixed member 154 and the edge guide 150, which comprises a parallel link mechanism. A compression coil spring 157 is provided to the plunger of the solenoid 152.

When a sheet manuscript is copied, as shown in FIG. 18, the actuator of the microswitch 151 is depressed down by the front edge of the supporting body 73 so that the solenoid 152 is not energized. Under this condition, the edge guide 150 is displaced toward right in FIG. 18 by the action of the spring 157. When a thick manuscript is to be copied by rotating the supporting body 73, as shown in FIG. 19, the microswitch 151 is switched on to energize the solenoid 152. Then, the plunger of the microswitch 151 is drawn back against the spring 157 so that the edge guide 150 is displaced toward left. As the levers 153 and 156 constitute a parallel link mechanism, the edge guide 150 is always moved in a parallel manner to the fixed member 154.

The invention is not limited to the above described embodiments, but various modifications and alternations are possible. For example, although the electrographic apparatus was a type of obtaining a plurality of copies by only one exposure in the above embodiments, the present invention, of course, may be applied to an electrographic apparatus of conventional type in which a single copy is obtained by one exposure. Other modifications will be described hereinafter.

For example, as means for detecting the insertion of the sheet or thick manuscript into the manuscript feed path, use may be made of a photoelectric switch, etc., instead of the microswitch.

In addition, in the case of obtaining copies of the thick manuscript, the supporting body 73 has been rotated about the supporting shaft 72 and disposed on the edge 4*a* of the manuscript discharge tray 4. But, the supporting body 73 may be disposed on the base surface of the manuscript discharge tray 4 or supported by a suitable stopper.

The manuscript discharge driving roller 32 composed of one elongate rubber roller may be composed of a plurality of short rubber rollers as in the case of the manuscript feed driving roller 25. Conversely, each of the manuscript feed driving roller 25, manuscript feed driven roller 26 and manuscript discharge driven roller 33 may be composed of an elongate rubber roller. In addition, use may be made of three or more than three pairs of the manuscript feed and discharge rollers instead of two pairs thereof. Similar to the manuscript feed driving roller 25, the manuscript discharge driving roller 32 may be provided at its each end with a pinion gear and hence it is possible to feed the thick manuscript carriage 85 with the aid of two pairs of pinion gears. The use of the two pairs of pinion gears ensures a reduction of the length of the racks 87 and 88 of the thick manuscript carriage 85. In this case, the pinion gears are required to be secured to the manuscript discharge driving roller 32 such that the teeth of the pinion gears are so adjusted in direction with respect to the teeth of the pinion gears 81 and 82 of the manuscript feed driving roller 25 that the racks 87 and 88 can correctly engage with these pinion gears.

In addition, the feed mechanism for the thick manuscript carriage 85 may be composed of a pair of rack and pinion gear instead of two pairs of racks and pinion gears as described in the previous embodiment.

The racks 87, 88 may be arranged along the side surface of the thick manuscript carriage 85 and the corresponding pinion gears 81, 82 may be arranged at the side surfaces of the light exposure portion 3 or supporting body 73. In this case also, use may be made of a pair of rack and pinion gear. Instead of using the rack-pinion gears, use may be made, for example, of a rack-helical gear, perforation-sprocket wheel, magnet tape-magnet roller and the like. In addition, instead of using the seamless photosensitive drum 14, use may be made of a seamed photosensitive drum or screen photosensitive body for the purpose of effecting operation of obtaining desired copies. In this case, it is preferable to control each operation by means of a signal emitted in synchronism with the rotation of the photosensitive body.

In the case of obtaining copies of the thick manuscript, the supporting body 73 may be removed from the manuscript feed path or may be rotated toward a direction perpendicular to the manuscript feed direction. In addition, the supporting body 73 may be rotated toward the manuscript carriage 2 so as to provide a rectilinear thick manuscript feed path. Alternatively, the manuscript feed driven roller 26 and manuscript discharge driven roller 33 may be composed of driving rollers as in the case of the manuscript feed driving roller 25 and manuscript discharge driving roller 32, that is, all of the rollers may be composed of driving rollers. Conversely, the rollers 26 and 33 provided for the supporting body 73 may be composed of driving rollers.

Alternatively, the thick manuscript carriage 85 may be constructed such that it can hold the peripheral edge of the thick manuscript. In the case of obtaining a single copy by one exposure, the light interruptive portion 92 may be preferably painted with white paint having substantially the same resistivity as a white manuscript, excluding a zone on which a manuscript is disposed.

The mechanism of displacing an edge guide for a sheet copy in response to a movement of an upper feed mechanism is not limited to the above described embodiments, but various modifications and alternations are possible. For example, a mechanical link mechanism such bevel gears, wires, link mechanisms or the like may be used. Moreover, in the case of detecting a movement of an upper feed mechanism by a microswitch, photoelectric switch and so on and of displacing the edge guide on the basis of a detected signal, use can be made of a method using a linear solenoid, a method using a rotary solenoid utilizing gears, belts and the like, and a method using fluid.

As described above, according to the electrographic apparatus, an edge guide for a sheet manuscript and an edge guide for a thick manuscript can be changed over automatically in response to a movement of upper feed mechanism so that no risk of mis-copying caused by forgetting of switching. In addition, a user is not bothered by a complicated switching operation and can obtain a desired copy very effectively.

What is claimed is:

1. An electrographic apparatus comprising a main body with a manuscript carriage table; a manuscript discharge tray detachably mounted on said main body; a slit light exposure portion mounted on said main body and interposed between said manuscript carriage table and said manuscript discharge tray, said slit light exposure portion defining a substantially rectilinear manuscript feed path and projecting a manuscript image therethrough; a manuscript feed mechanism including upper and lower feed mechanisms arranged above and below said manuscript feed path at said slit light exposure portion, said upper feed mechanism being arranged movably with respect to said lower feed mechanism; a photosensitive body for memorizing said manuscript image projected through said slit light exposure portion thereon as an electrostatic latent image; a sheet manuscript edge guide for determining a position of a side edge of a sheet manuscript; a thick manuscript edge guide for determining a position of a side edge of a thick manuscript, said thick manuscript edge guide being arranged outside said sheet manuscript edge guide viewed in a direction perpendicular to said manuscript feed path; and a means for automatically changing said two edge guides in response to a movement of said upper feed mechanism with respect to said lower feed mechanism; the apparatus being constructed and arranged such that in the case of obtaining copies of a sheet manuscript said sheet manuscript is fed by said manuscript feed mechanism under a condition that said upper feed mechanism is mounted on said lower feed mechanism and in the case of obtaining copies of a thick manuscript a thick manuscript carriage on which is disposed said thick manuscript is fed along the manuscript carriage table by said lower feed mechanism under a condition that said upper feed mechanism is moved from said lower feed mechanism.

2. An apparatus as defined in claim 1, wherein said thick manuscript edge guide is fixed to said main body and said sheet manuscript edge guide comprises a channel-like member arranged rotatably about an axis extending in paralled with the feed path, a coil spring provided about the axis in such a manner that the channel-like member is biased to rotate in one direction, and a pin arranged at one side of the channel-like member opposed to said upper feed mechanism, said pin being engaged with a curved recess formed at a front edge of a supporting body supporting said upper feed mechanism; said automatic changing mechanism of said two edge guides being constructed such that in the case of obtaining at least one copy of the sheet manuscript said supporting body supporting said upper feed mechanism is closed and thereby said sheet manuscript edge guide is rotated through an engagement of said pin with said curved recess against a force of said spring and in the case of obtaining at least one copy of the thick manuscript said supporting body supporting said upper feed mechanism is rotated and thereby said sheet manuscript edge guide is rotated by a force of said spring.

3. An apparatus as defined in claim 2, wherein said upper feed mechanism including said supporting body has sufficient weight for pressing said sheet manuscript edge guide against the force of said spring.

4. An apparatus as defined in claim 2, wherein the apparatus is constructed such that said sheet manuscript edge guide is protruded below a top surface of the manuscript carriage table.

5. An apparatus as defined in claim 2, wherein a pin is provided at a side of said thick manuscript edge guide and an arcuate slot is formed at a side of sheet manuscript edge guide, said pin and said arcuate slot being engaged with each other so as to provide a stopper for rotation of sheet manuscript edge guide.

6. An apparatus as defined in claim 1, wherein said sheet manuscript edge guide is made rotatably about an axis extending perpendicularly to the feed path and capable of protruding through a slit-like hole formed in the manuscript carriage table, and the main body is provided with a tension spring one end of which is attached to said sheet manuscript edge guide and with a rotatable L-shaped lever one end of which is able to be abutted to said sheet manuscript edge guide and the other end of which is able to protrude above the manuscript carriage table; the automatic changing mechanism of said two edge guides being constructed such that in the case of obtaining at least a copy of the sheet manuscript said upper feed mechanism supporting body is closed and thereby said other protruding end of said L-shaped lever is pressed down by a front edge of said supporting body to rotate said sheet manuscript edge guide against a force of said tension spring and to cause said sheet manuscript edge guide protrude through said hole above said manuscript carriage table and in the case of obtaining at least one copy of the thick manuscript said upper feed mechanism supporting body is rotated and thereby said sheet manuscript edge guide is drawn back under said manuscript carriage table by said tension spring.

7. An apparatus as defined in claim 1, wherein said sheet manuscript edge guide is attached to the front edge of said supporting body and can be rotated therewith.

8. An apparatus as defined in claim 7, wherein a protrusion is provided at the front edge of said supporting body, said protrusion being provided with an elongated hole through which a pin having an elliptical cross section is inserted, both ends of said pin being secured to said sheet manuscript edge guide.

9. An apparatus as defined in claim 7, wherein a protrusion is provided at the front edge of said supporting body, said protrusion being provided with a circular hole through which a pin having a circular cross section is inserted, both ends of said pin being secured to said sheet manuscript edge guide.

10. An apparatus as defined in claim 7, wherein in the case of obtaining the copy of thick manuscript an upper surface of said sheet manuscript edge guide and an upper surface of said supporting body are aligned substantially in one plane, said edge guide and supporting body being upside down.

11. An apparatus as defined in claim 7, wherein a slit-like hole is provided in the manuscript discharge tray and through this hole said sheet manuscript edge guide can protrude under the manuscript carriage table.

12. An apparatus as defined in claim 1, wherein said sheet manuscript edge guide is provided at its one end with a tension spring the other end of which is attached to the main body and at the other end with a switch, a solenoid driving circuit and a solenoid having a plunger; automatic changing mechanism of said two edge guides being constructed such that in the case of obtaining the copy of sheet manuscript said upper feed mechanism supporting body is closed and thereby said microswitch is not driven and said solenoid is not energized and said sheet manuscript edge guide is protruded above the manuscript carriage table by said spring and that in the case of obtaining the copy of thick manuscript said supporting body is rotated and thereby said switch is turned on and supplies a signal to said solenoid driving circuit which then energizes said solenoid and its plunger is retired so that said sheet manuscript edge guide is drawn back under said manuscript carriage table.

13. An apparatus as defined in claim 12, wherein said switch consists of a microswitch having an actuator, said actuator being pressed down or released by said front edge of said supporting body.

14. An apparatus as defined in claim 12, wherein said switch is a photoelectric switch.

15. An apparatus as defined in claim 1, wherein said sheet manuscript edge guide can be moved in a parallel manner to a fixed member by use of a parallel link mechanism.

16. An apparatus as defined in claim 15, wherein said parallel link mechanism consists of a first lever and a second lever, these two levers being rotatably jointed about each axis fixed to said fixed member.

17. An apparatus as defined in claim 16, wherein said first lever is attached at its one end to a plunger, having a spring, of solenoid, said solenoid being energized or not energized by a switch; the automatic changing mechanism being constructed such that in the case of obtaining the copy of sheet manuscript said supporting body supporting said upper feed mechanism is closed and thereby said switch is not driven and said sheet manuscript edge guide is moved in such a manner as to leave from said fixed member by said spring and in the case of obtaining the copy of sheet manuscript said upper feed mechanism supporting body is rotated and thereby said switch is turned on and then said solenoid is energized to draw back said plunger, by which said sheet manuscript edge guide is moved toward said fixed member through said parallel link mechanism.

18. An apparatus as defined in claim 17, wherein said switch is a microswitch.

19. An apparatus as defined in claim 17, wherein said switch is a photoelectric switch.

* * * * *